US011465438B2

(12) United States Patent
MacNeill

(10) Patent No.: US 11,465,438 B2
(45) Date of Patent: Oct. 11, 2022

(54) FRAME-BASED DECORATIVE ARTICLE AND METHOD OF ASSEMBLY

(71) Applicant: Laurie MacNeill, Stony Creek (CA)

(72) Inventor: Laurie MacNeill, Stony Creek (CA)

( * ) Notice: Subject to any disclaimer, the term of this patent is extended or adjusted under 35 U.S.C. 154(b) by 363 days.

(21) Appl. No.: 15/993,517

(22) Filed: May 30, 2018

(65) Prior Publication Data

US 2021/0078358 A1 Mar. 18, 2021

Related U.S. Application Data

(60) Provisional application No. 62/512,375, filed on May 30, 2017.

(51) Int. Cl.

| | |
|---|---|
| ***A41G 1/04*** | (2006.01) |
| ***B44C 3/12*** | (2006.01) |
| ***A47G 1/06*** | (2006.01) |
| *A63F 9/00* | (2006.01) |

(52) U.S. Cl.

CPC ..... *B44C 3/12* (2013.01); *A47G 1/0616* (2013.01); *A41G 1/04* (2013.01); *A63F 2009/0033* (2013.01); *Y10T 428/216* (2015.01); *Y10T 428/218* (2015.01)

(58) Field of Classification Search

None

See application file for complete search history.

(56) References Cited

U.S. PATENT DOCUMENTS 5,501,889 A * 3/1996 Church ..... A01G 5/04 428/10

* cited by examiner

*Primary Examiner* — Alexander S Thomas

(74) *Attorney, Agent, or Firm* — Woodard, Emhardt, Henry, Reeves & Wagner, LLP

(57) ABSTRACT

A frame-based decorative article comprises a frame, a plurality of receiving holes in the frame, a plurality of decorations to be secured to the frame, and a plurality of flexible securing members for securing the decorations to the frame. The plurality of flexible securing members extend through a selected pair of receiving holes in the frame and surround a portion of at least one of the decorations and the portion of the frame between the two receiving holes, to thereby secure the plurality of decorations one adjacent others in outwardly projecting relation on the frame.

25 Claims, 35 Drawing Sheets
(26 of 35 Drawing Sheet(s) Filed in Color)

138, 132

FIG 35
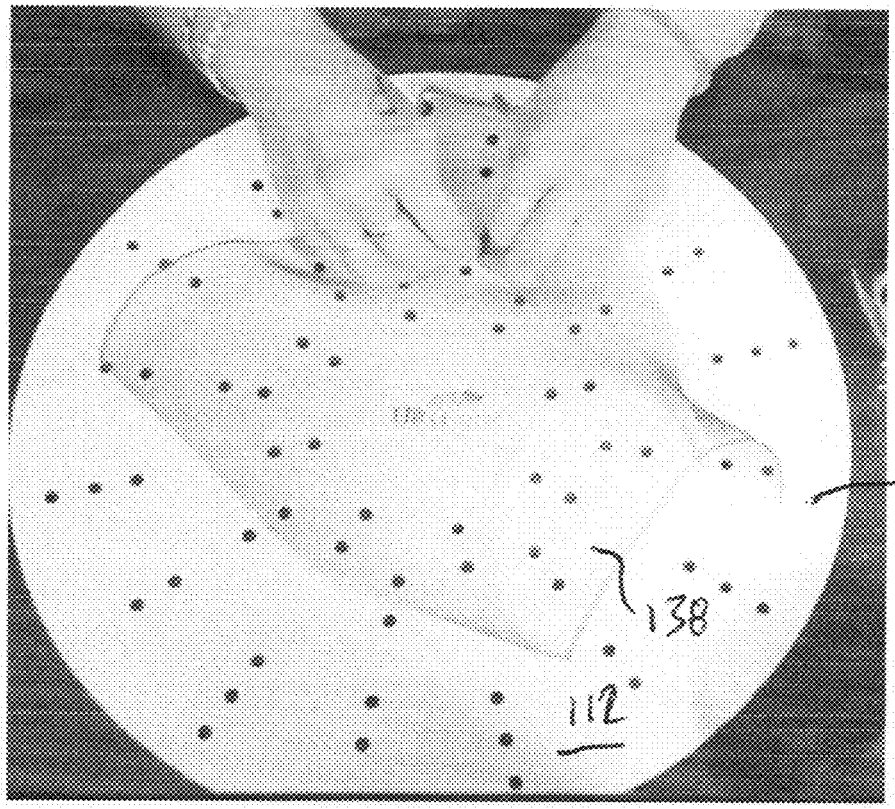
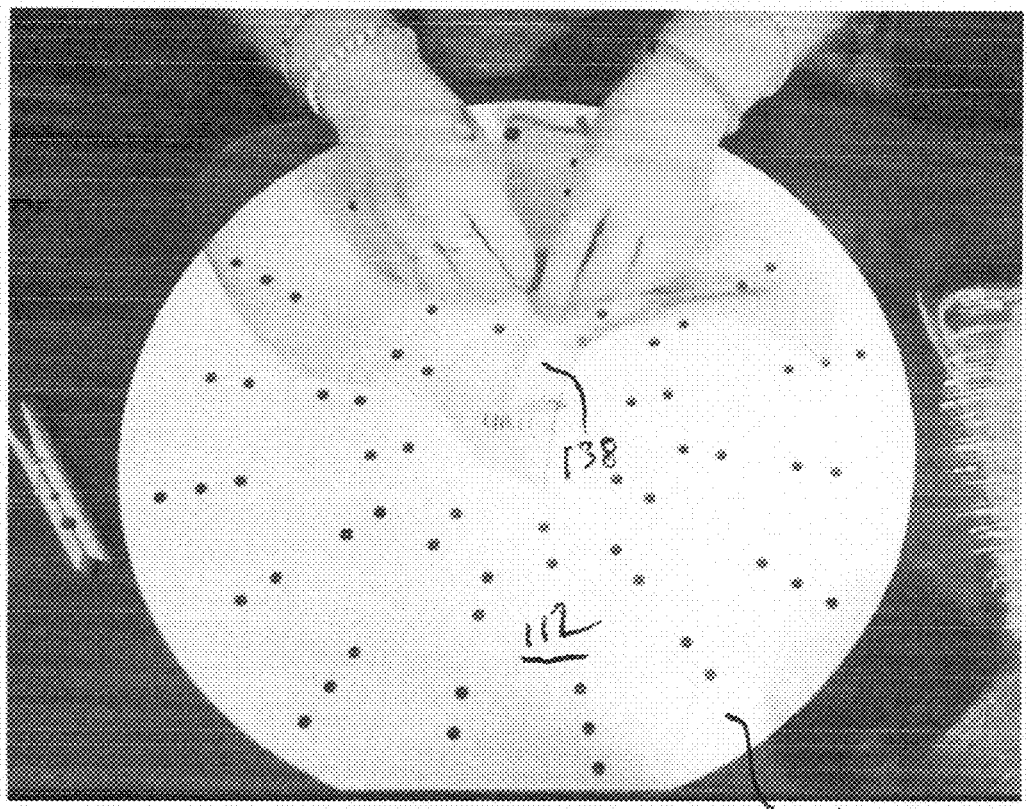
FIG 36

FIG 37
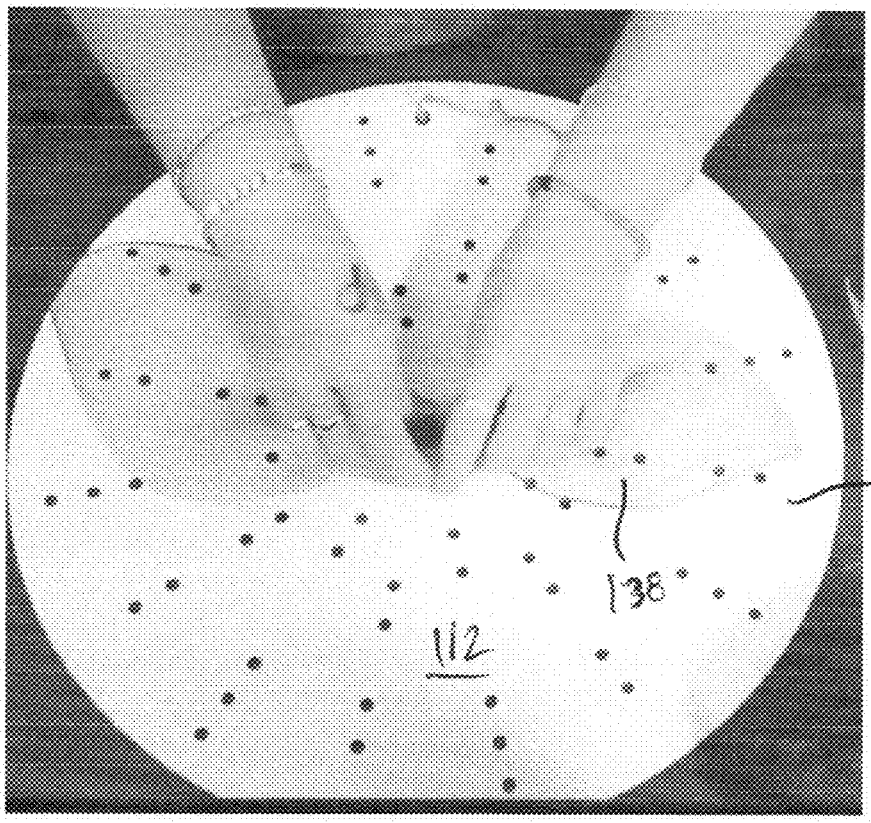
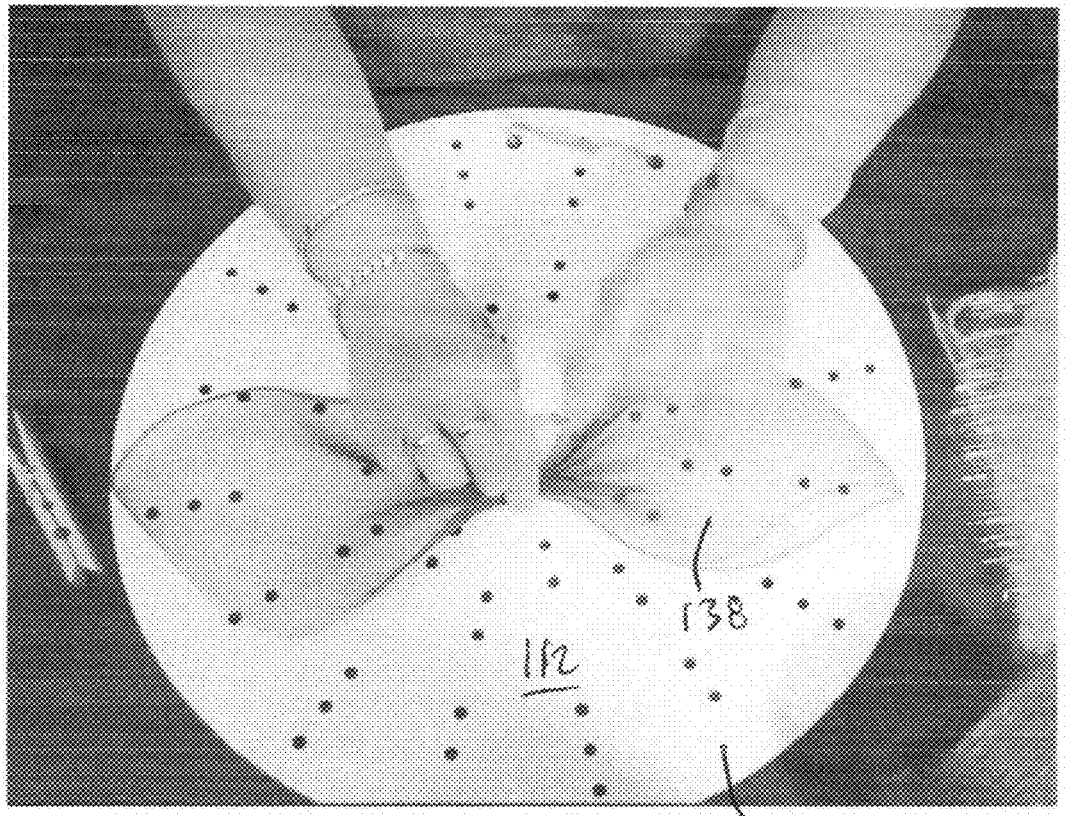
FIG 38

FIG 49
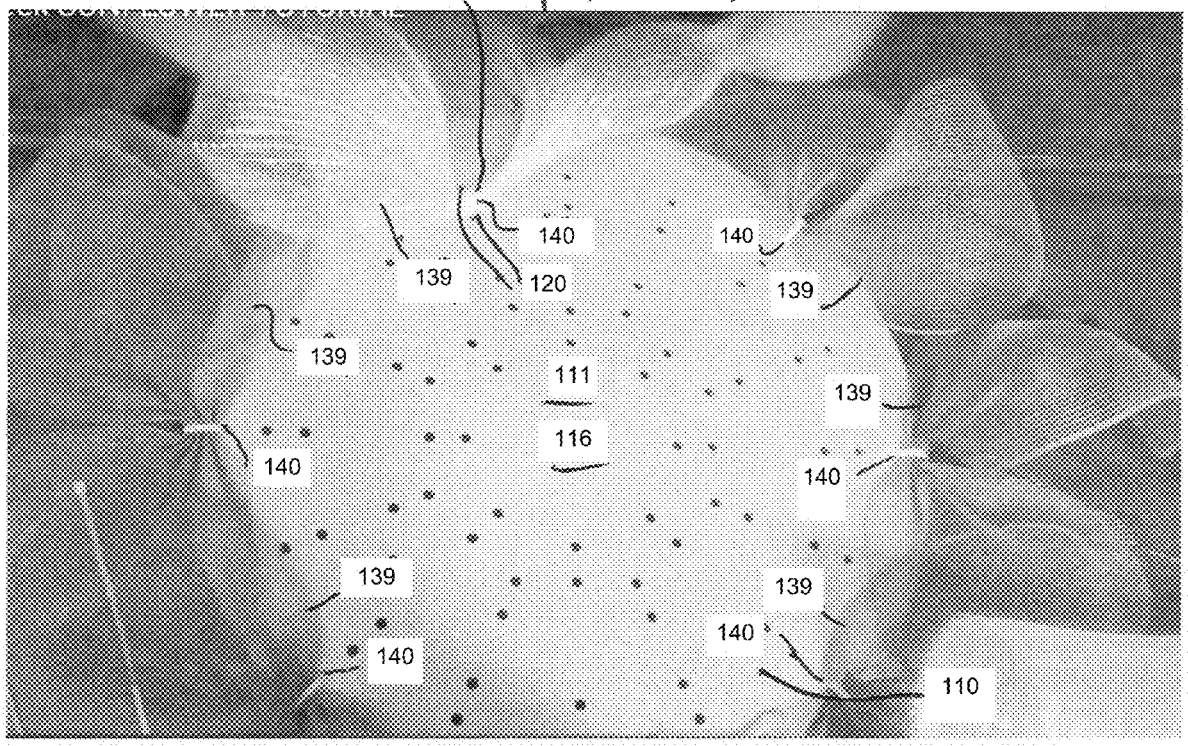
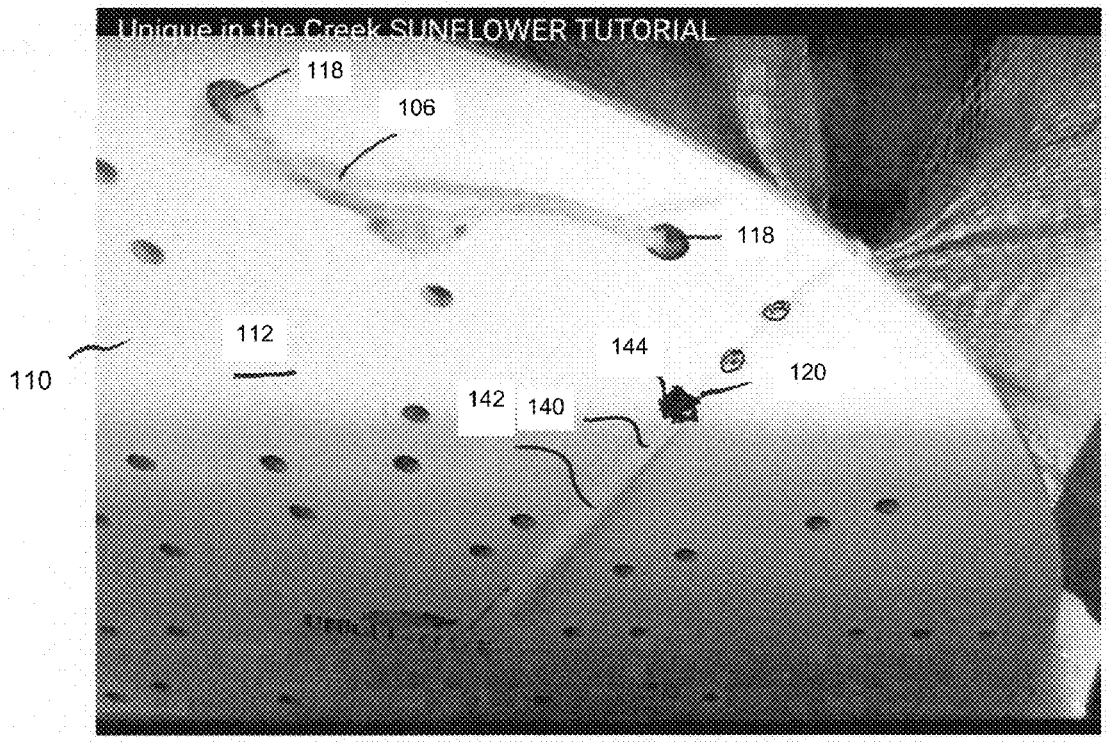
FIG 50

FIG 53
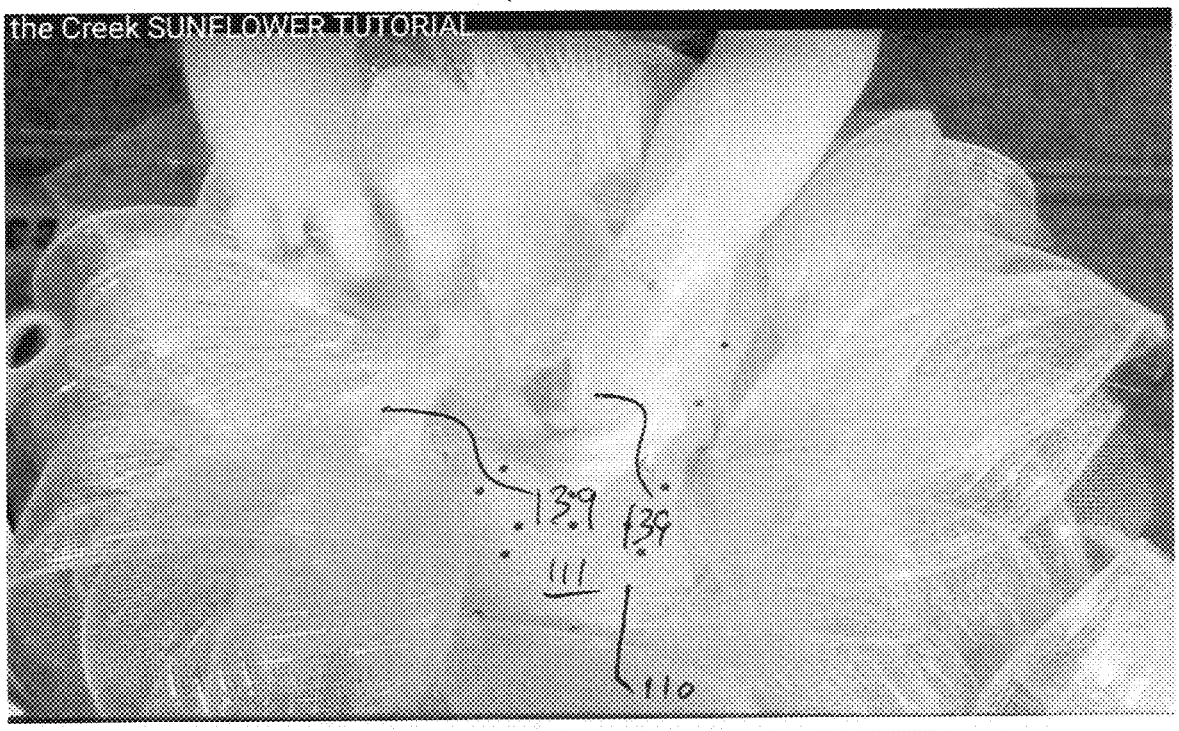
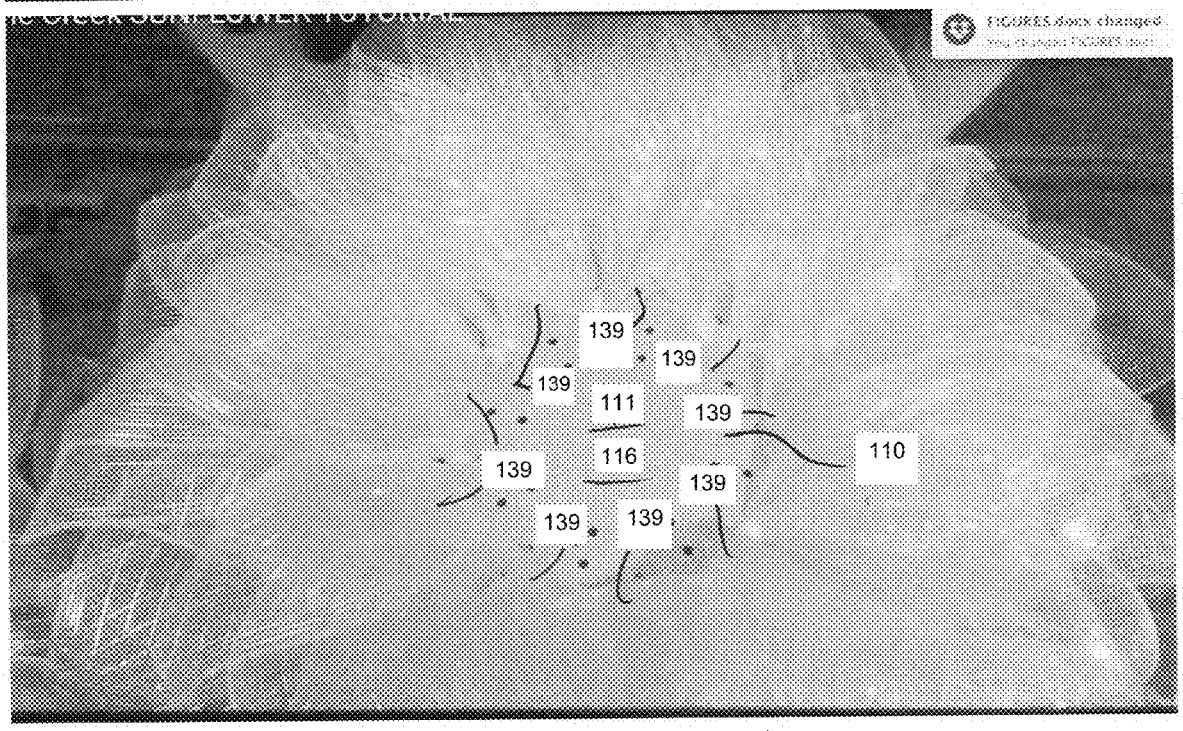
FIG 54

FIG 55
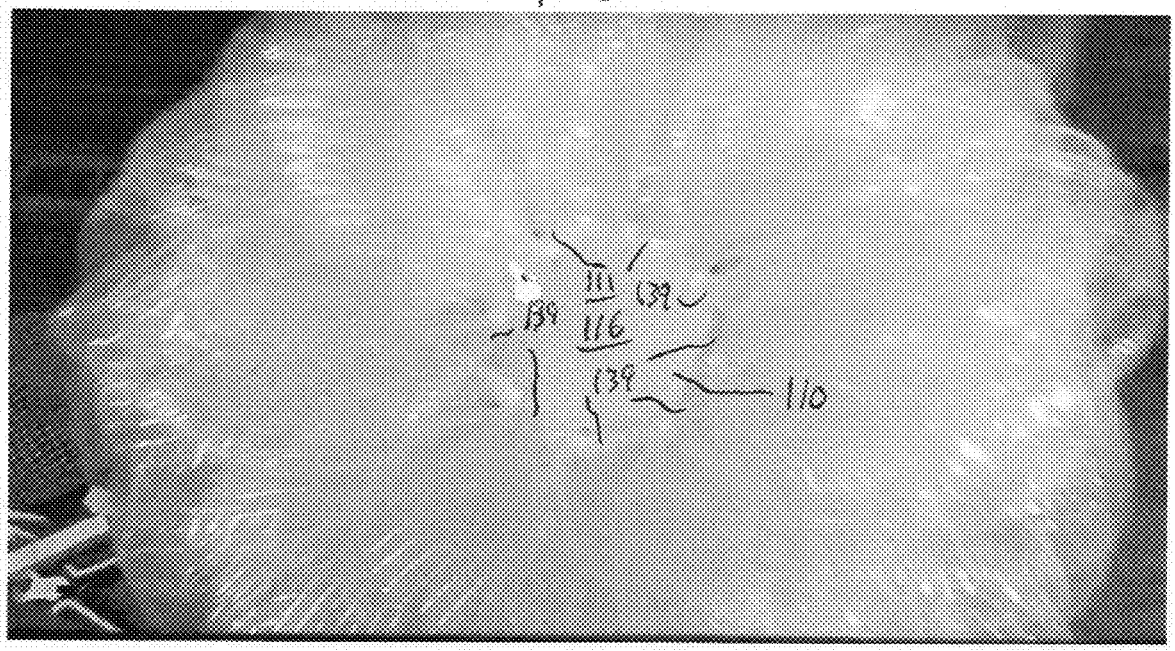
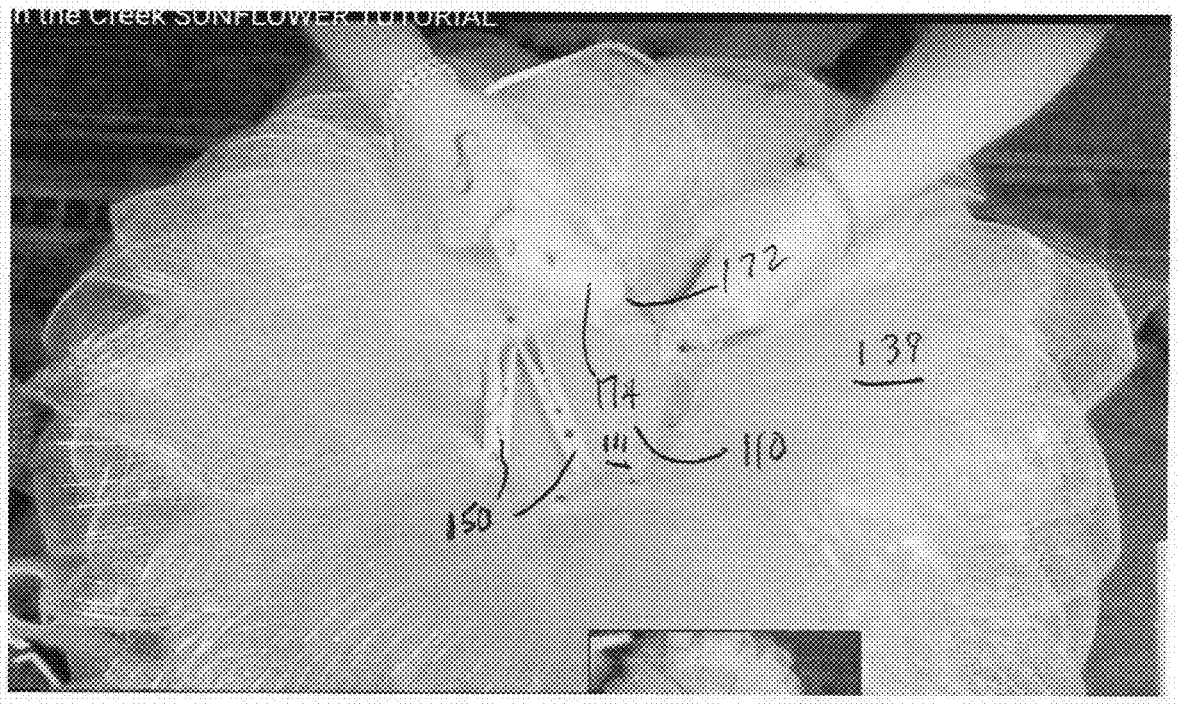
FIG 56

FIG 57
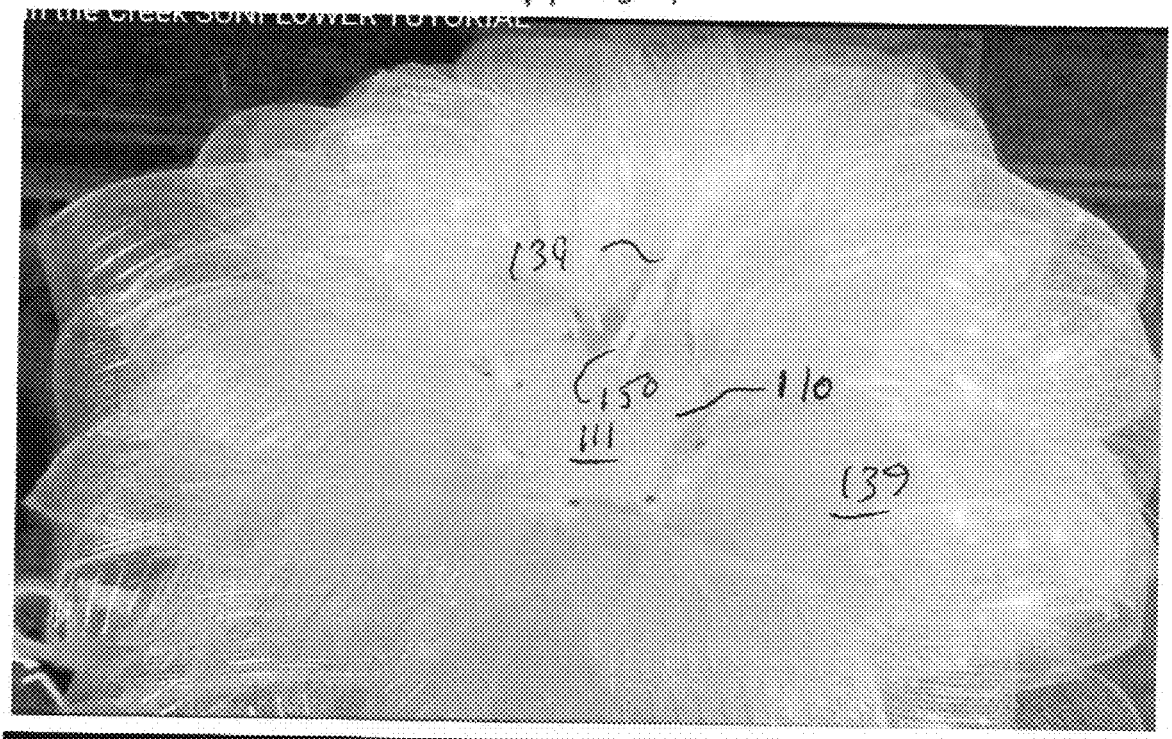
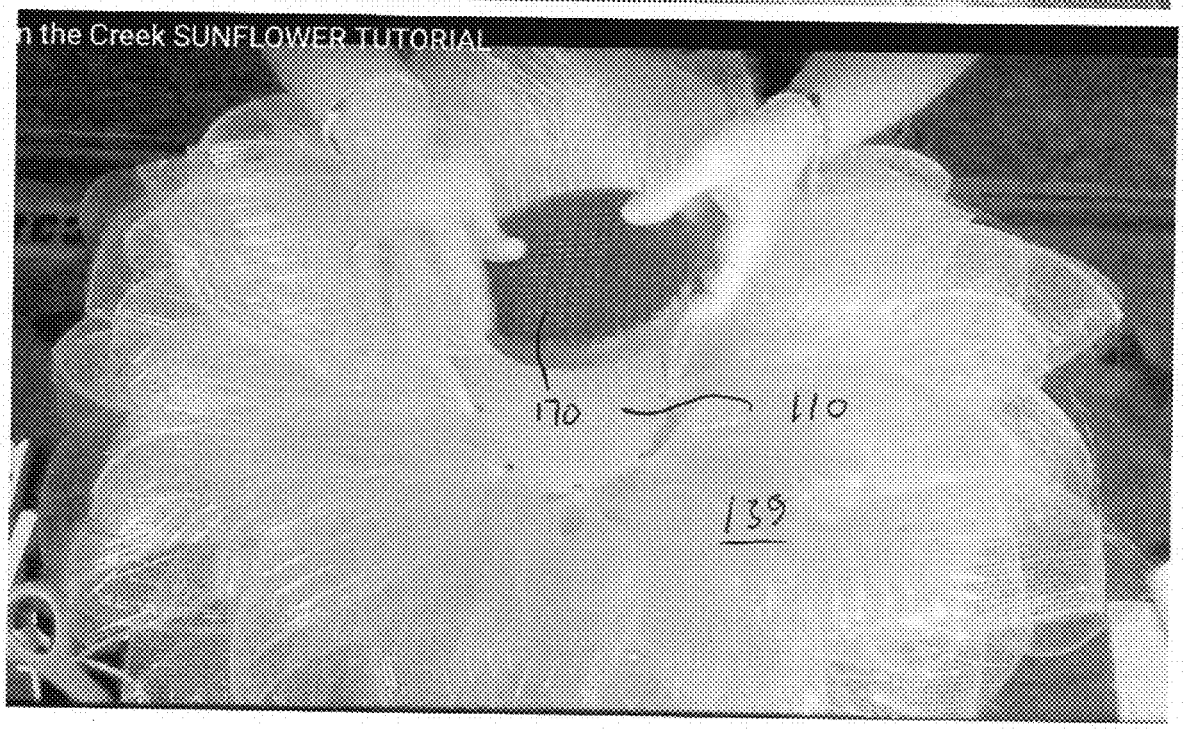
FIG 58

100

FRAME-BASED DECORATIVE ARTICLE AND METHOD OF ASSEMBLY

FIELD OF THE INVENTION

The present invention relates to frame-based decorative articles, and more particularly relates to frame-based decorative articles that are readily assembled by a person, such as a craft hobbyist.

BACKGROUND OF THE INVENTION

Crafts in the area of decorative articles, such as wreaths, table decorations, wall decorations, and the like, can be purchased either fully assembled or as a kit, or even as individual pieces by those who are perhaps more experienced or wish to experiment somewhat. Kits are very popular as they present an enjoyable pastime for an end user, typically an arts and crafts hobbyist. Such kits allow for numerous types and styles of decorative articles to be made by even unskilled hobbyists.

By way of example, wreaths that are assembled by an end user and that typically hang on doors or walls can be structured in many ways. Indeed, there are various types of prior art kits that present various degrees of complexity for the end user in terms of assembly by the end user. It has been found by the present inventor that some of the fundamental problems with prior art decorative article kits, such as wreath kits, are that they tend to be complex in terms of their structure and components. Such complexity tends to take the fun out of the assembly of such decorative articles, which is the opposite of what a hobby should do. Further, known prior art kits are difficult to assemble, or even very difficult to assemble, especially by people who may have reduced dexterity in their hands. Also, known prior art kits are more time consuming to assemble than is desirable, thereby often causing the hobbyist to lose interest and possibly not finish assembly of the kit.

The closest known prior art is believed to U.S. Pat. No. 3,591,442, issued Jul. 6, 1971 to Matesi, and entitled Decorative Wreaths. In this patent, there is disclosed a wreath that is decorated with foliage such as artificial leaves and berries mounted on a base unit. The non-flat base unit has a peripheral section that is semicircular in cross-section. There may also be at disc-shaped center section. The preferred attachment means comprises holes in the peripheral section and may comprise sections of gum gluey substance.

A binding having a knob can be used to trap the stem section of an artificial bough. The knob is pliable so that it can be forced through the holes, yet can also retain the binding in place. Wires can be twisted together to secure the decorations to the base unit. As shown and taught, this prior art wreath has the stem sections of artificial greenery retained flat against the base, and relies on the peripheral section that is semicircular in cross-section to provide depth to the wreath.

Other relevant prior art include the following patents.

U.S. Pat. No. 1,517,848, issued Dec. 2, 1924 to McClelland, and entitled Illuminated Wreath, discloses a wreath comprising a flat ring-like backing with a plurality of lights mounted thereon, and springs from a plant mounted over the lights and flat ring-like backing.

U.S. Pat. No. 2,727,326, issued Dec. 20, 1955 to MacGregor, and entitled Wreath, discloses a wreath comprising a circularly formed supporting wire inserted through a plurality of conical wood cuttings. The wood cuttings also rest against an annular flat support member and are adhered thereto.

U.S. Pat. No. 2,761,233, issued Sep. 4, 1956 to Brown, and entitled Wreath, discloses a wreath comprising an annular member having a plurality of small slits formed in a plurality of radially spaced rows. One edge of each slit is bulged outwardly from the front face of the annular member. The slits receive stems of plants or foliage therein.

It is an object of the present invention to provide a decorative article.

It is an object of the present invention to provide a decorative article, such as a wreath or a table decoration.

It is an object of the present invention to provide a decorative article that is not complex in terms of its structure and components.

It is an object of the present invention to provide a decorative article that is not difficult to assemble.

It is an object of the present invention to provide a decorative article that is not difficult to assemble by people who may have reduced dexterity in their hands.

It is an object of the present invention to provide a decorative article that is not overly time consuming to assemble.

It is an object of the present invention to provide a decorative article that does not rely on a non-flat base to provide depth to the decorative article.

It is an object of the present invention to provide a kit for forming a decorative article.

It is an object of the present invention to provide a kit for forming a decorative article, such as a wreath or a table decoration.

It is an object of the present invention to provide a kit for forming a decorative article that is not complex in terms of its structure and components.

It is an object of the present invention to provide a kit for forming a decorative article that is not difficult to assemble.

It is an object of the present invention to provide a kit for forming a decorative article that is not difficult to assemble by people who may have reduced dexterity in their hands.

It is an object of the present invention to provide a kit for forming a decorative article that is not overly time consuming to assemble.

It is an object of the present invention to provide a kit for forming a decorative article that does not rely on a non-flat base to provide depth to the kit for forming a decorative article.

It is an object of the present invention to provide a method of forming a decorative article.

It is an object of the present invention to provide a method of forming a decorative article, such as a wreath or a table decoration.

It is an object of the present invention to provide a method of forming a decorative article that is not complex in terms of its structure and components.

It is an object of the present invention to provide a method of forming a decorative article that is not difficult to assemble.

It is an object of the present invention to provide a method of forming a decorative article that is not difficult to assemble by people who may have reduced dexterity in their hands.

It is an object of the present invention to provide a method of forming a decorative article that is not overly time consuming to assemble.

It is an object of the present invention to provide a method of forming a decorative article that does not rely on a non-flat base to provide depth to the method of forming a decorative article.

SUMMARY OF THE INVENTION

In accordance with one aspect of the present invention there is disclosed a novel frame-based decorative article comprising a frame, a plurality of receiving holes in the frame, a plurality of decorations to be secured to the frame, and a plurality of flexible securing members for securing the decorations to the frame. The plurality of flexible securing members extend through a selected pair of receiving holes in the frame and surround a portion of at least one of the decorations and the portion of the frame between the two receiving holes, to thereby secure the plurality of decorations one adjacent others in outwardly projecting relation on the frame.

In accordance with another aspect of the present invention there is disclosed a novel kit for forming a frame-based decorative article. The kit comprises a frame, a plurality of receiving holes in the frame, a plurality of decorations to be secured to the frame, and a plurality of flexible securing members for securing the decorations to the frame. The plurality of flexible securing members extend through a selected pair of receiving holes in the frame and surround a portion of at least one of the decorations and the portion of the frame between the two receiving holes, to thereby secure the plurality of decorations one adjacent others in outwardly projecting relation on the frame.

In accordance with another aspect of the present invention there is disclosed a novel method of assembling a frame-based decorative article comprising a frame having a plurality of receiving holes, a plurality of decorations, and plurality of ties. The method comprises the steps of (a) placing a decoration on the frame; (b) surrounding a flexible securing member around a portion of the placed decoration and a portion of the frame; (c) closing the flexible securing member to a decoration-retaining configuration around the surrounded portion of the decoration and the surrounded portion of the frame, to thereby secure the decoration in outwardly projecting relation onto the frame; and (d) repeating steps (a) through (c) to thereby secure the plurality of decorations one adjacent others in outwardly projecting relation on the frame.

In accordance with another aspect of the present invention there is disclosed novel instructions for assembling a frame-based decorative article comprising a frame having a plurality of receiving holes, a plurality of decorations, and plurality of ties. The instructions comprise the steps of (a) placing a decoration on the frame; (b) surrounding a flexible securing member around a portion of the placed decoration and a portion of the frame; (c) closing the flexible securing member to a decoration-retaining configuration around the surrounded portion of the decoration and the surrounded portion of the frame, to thereby secure the decoration in outwardly projecting relation onto the frame; and (d) repeating steps (a) through (c) to thereby secure the plurality of decorations one adjacent others in outwardly projecting relation on the frame.

In accordance with another aspect of the present invention there is disclosed a novel frame for use in forming a frame-based decorative article. The frame comprises a main body, and a plurality of receiving holes in the main body. The receiving holes are arranged in a first circular pattern and a second circular pattern. The first circular pattern and the second circular pattern are generally concentric one with the other.

In accordance with another aspect of the present invention there is disclosed a novel frame for use in forming a frame-based decorative article. The frame comprises a main body and a plurality of receiving holes in the main body. The receiving holes are arranged in receiving holes.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the frame-based decorative article according to the present invention, as to its structure, organization, use and method of operation, together with further objectives and advantages thereof, will be better understood from the following drawings in which a presently known embodiment of the invention will now be illustrated by way of example. It is expressly understood, however, that the drawings are for the purpose of illustration and description only, and are not intended as a definition of the limits of the invention. The patent or application file contains at least one drawing executed in color. Copies of this patent or patent application publication with color drawings will be provided by the Office upon request and payment of the necessary fee.

FIG. 35 is a diagrammatic view of the single piece of flexible plastic mesh material being initially scrunched;

FIG. 36 is a diagrammatic view of the single piece of flexible plastic mesh material being scrunched some more;

FIG. 37 is a diagrammatic view of the single piece of flexible plastic mesh material being scrunched even more;

FIG. 38 is a diagrammatic view of the single piece of flexible plastic mesh material fully scrunched;

FIG. 49 is a diagrammatic view showing one of the flexible securing members being closed around the mesh material petal;

FIG. 50 is a diagrammatic view showing one of the flexible securing members being tightened around the mesh material petal;

FIG. 53 is a diagrammatic view showing two mesh material petals about to be placed at a pair of radially aligned holes in the third circular pattern of receiving holes, to thereby form a double petals;

FIG. 54 is a diagrammatic view showing all of the mesh material petals in the third circular pattern of receiving holes having been secured onto the frame;

FIG. 55 is a diagrammatic view showing all of the mesh material petals in the fourth circular pattern of receiving holes having been secured onto the frame, and accordingly, all of the mesh material petals in all of the circular patterns of receiving holes having been secured of the frame;

FIG. 56 is a diagrammatic view showing an amount of hot melt adhesive being applied to the edge of two of the mesh material petals in the fourth circular pattern of receiving holes of the frame, adjacent the central inner core area of the frame;

FIG. 57 is a diagrammatic view showing a clothes pin being used to pinch together the adjacent portions of each petal of the fourth circular row of holes adjacent the central inner core area of the frame;

FIG. 58 is a diagrammatic view showing the foam center disc being adhered to the central inner core area of the frame using a hot melt adhesive;

LIST OF REFERENCE NUMERALS AND COMPONENTS

Figure 1:
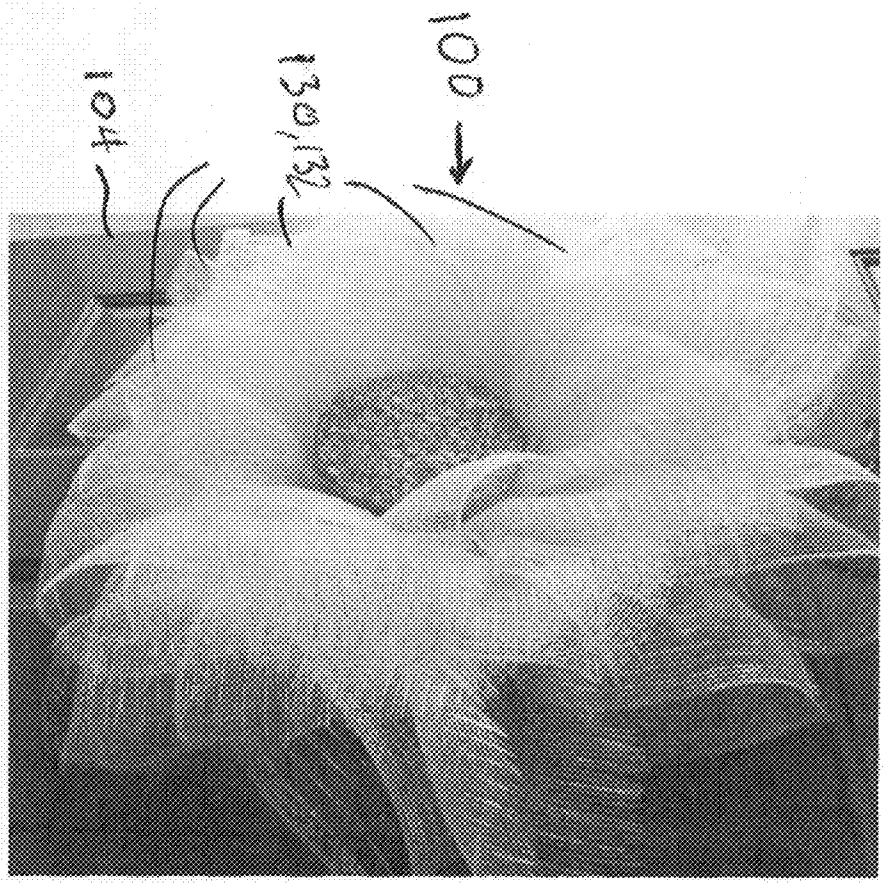
FIG. 1 is a perspective view from the front of the first illustrated embodiment frame-based decorative article according to the present invention hanging on a door.
Figure 2:
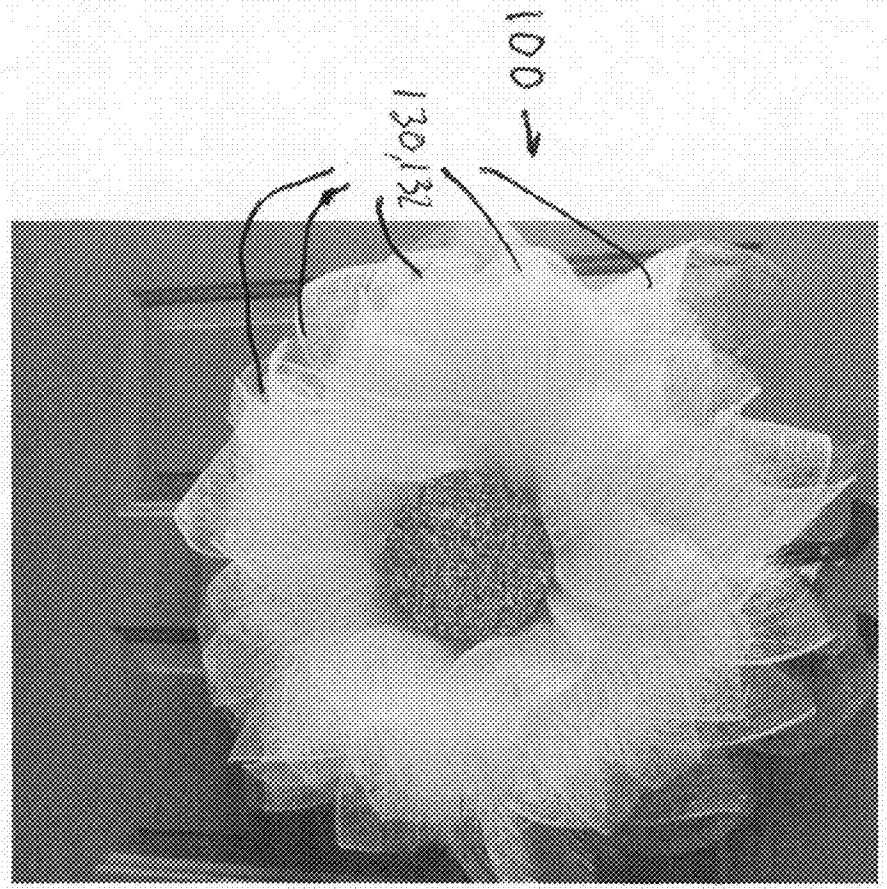
FIG. 2 is a front view of the first illustrated embodiment frame-based decorative article of FIG. 1.
Figure 3:
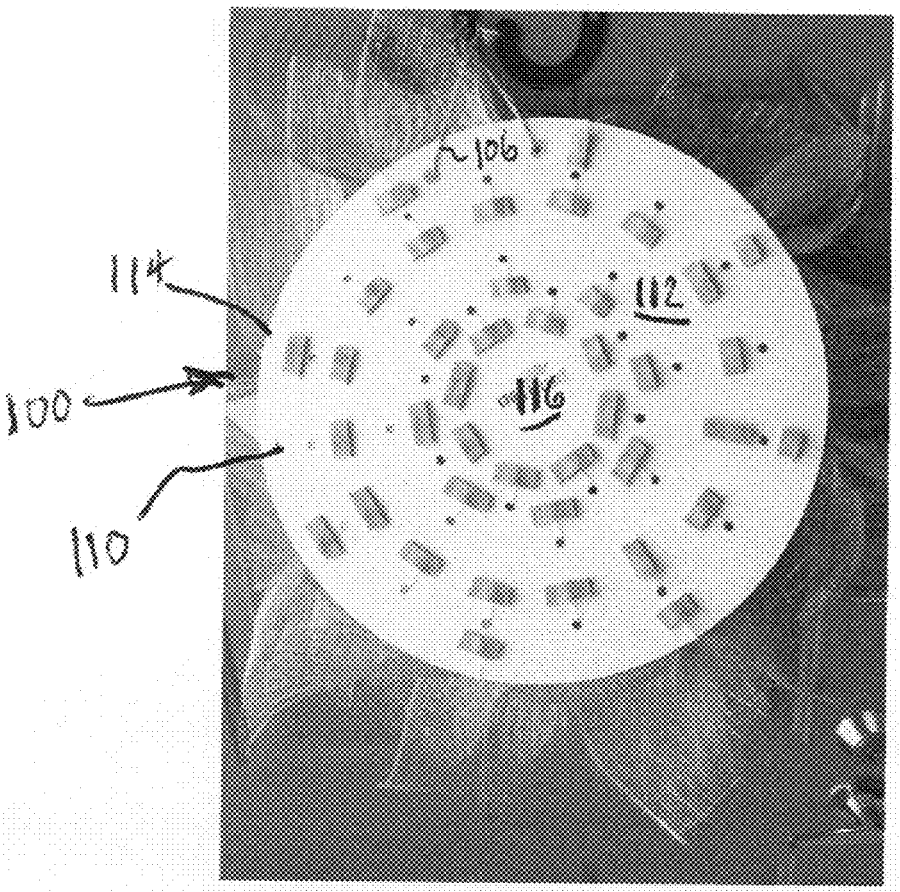
FIG. 3 is a back view of the first illustrated embodiment frame-based decorative article of FIG. 1.
Figure 4:
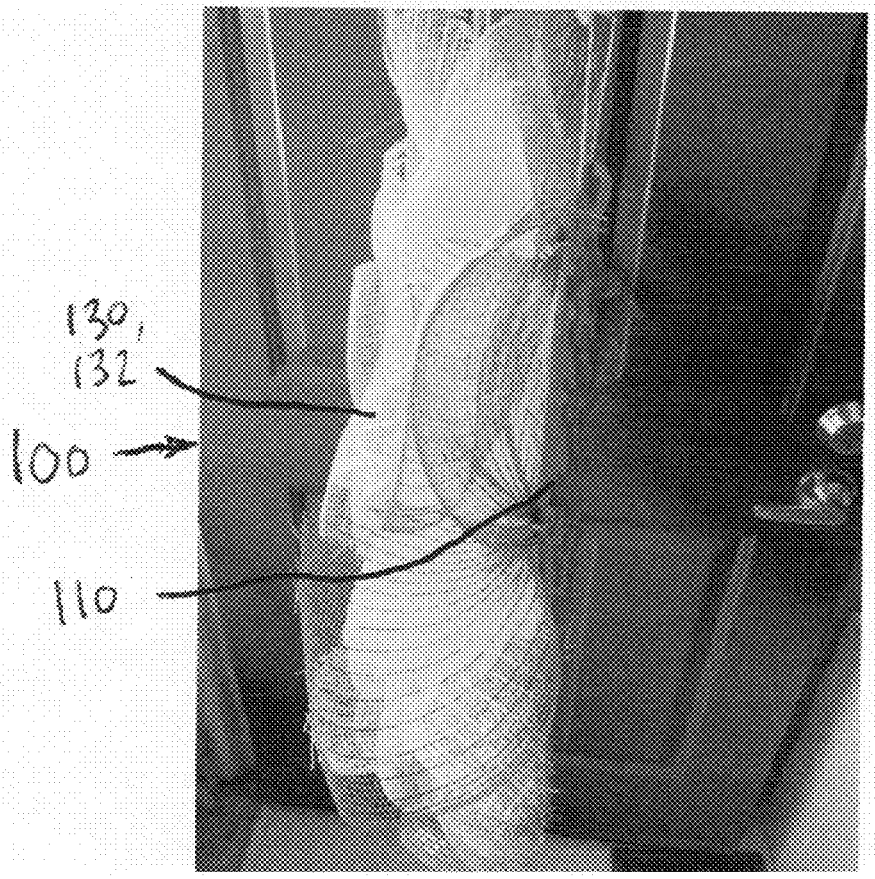
FIG. 4 is a side view of the first illustrated embodiment frame-based decorative article of FIG. 1.
Figure 5:
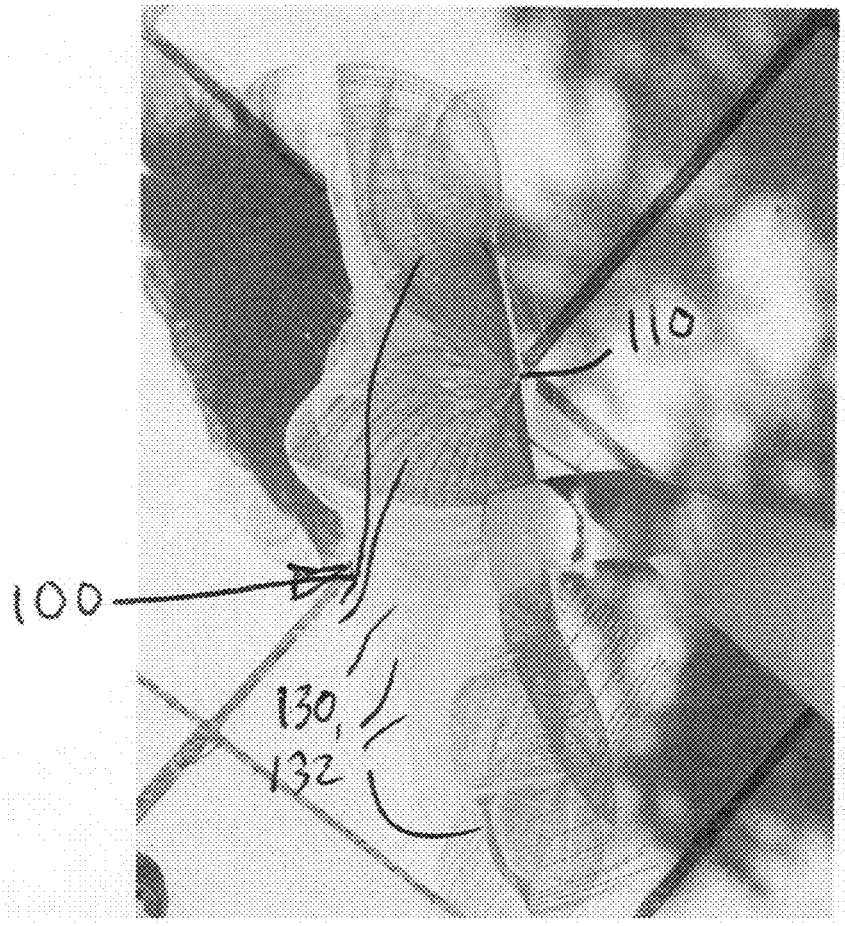
FIG. 5 is a top view of the first illustrated embodiment frame-based decorative article of FIG. 1.
Figure 6:
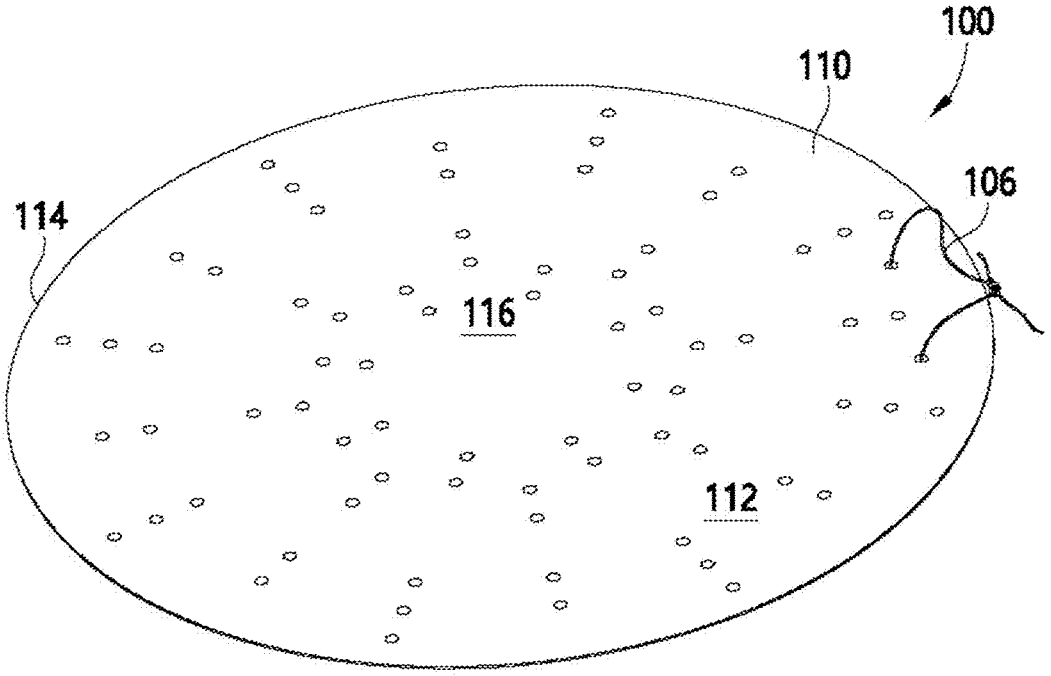
FIG. 6 a perspective view of the frame used in the construction of the first illustrated embodiment frame-based decorative article of FIG. 1.
Figure 7:
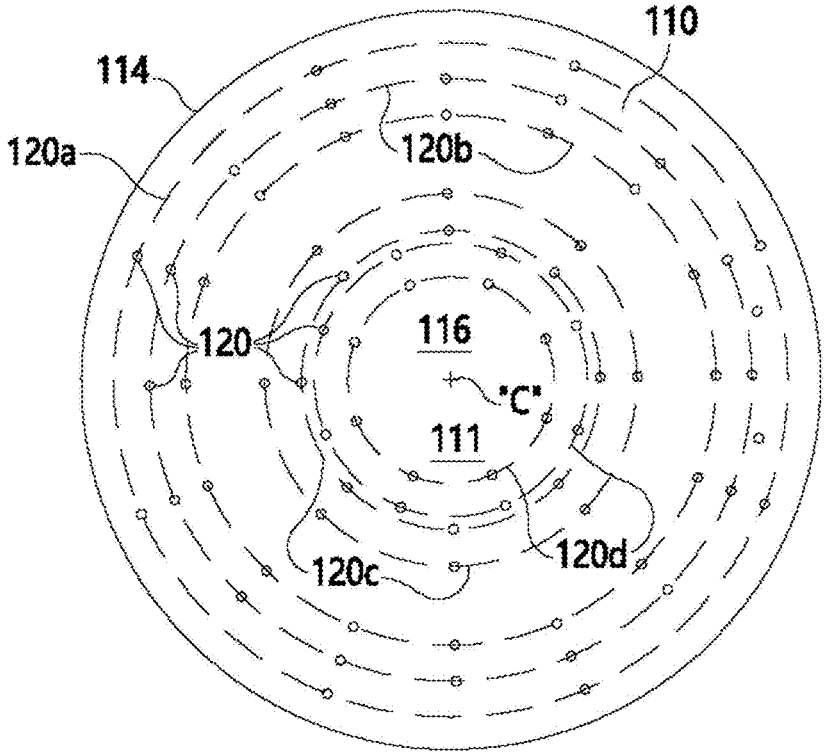
FIG. 7 is a front view of the frame used in the construction of the first illustrated embodiment frame-based decorative article of FIG. 1.
Figure 8:
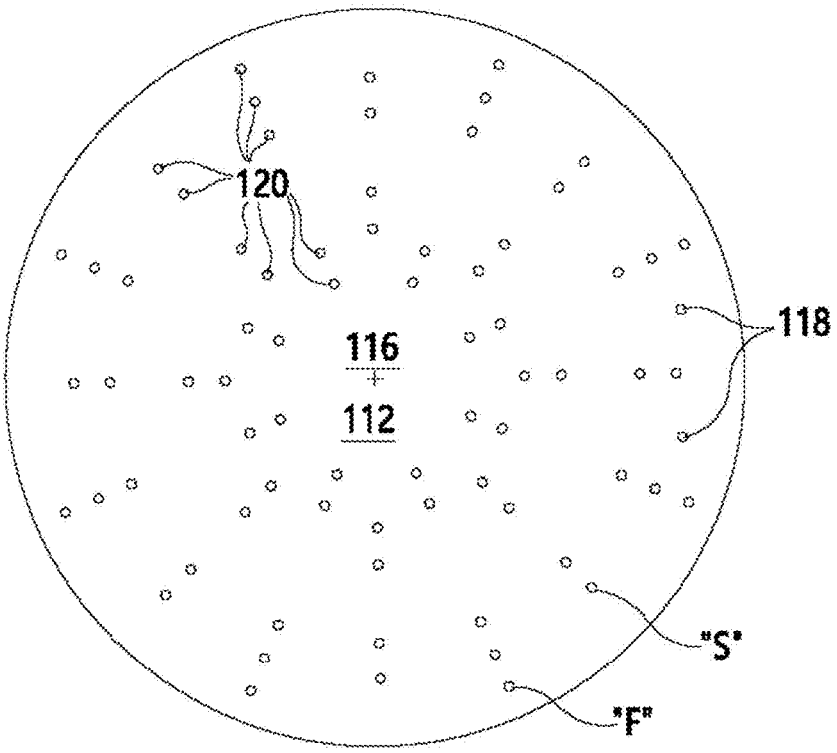
FIG. 8 is a back view of the frame used in the construction of the first illustrated embodiment frame-based decorative article of FIG. 1.
Figure 9:
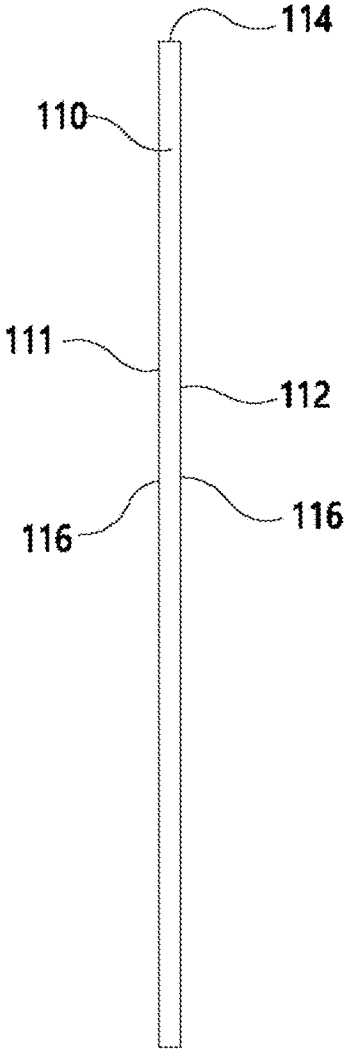
FIG. 9 is a side view of the frame used in the construction of the first illustrated embodiment frame-based decorative article of FIG. 1.

100 frame-based decorative article
100*w* wreath
104 door
106 hanging member
110 frame
111 first decoration-receiving face
112 second decoration-receiving face
113 main body
114 circular peripheral edge
116 inner core area
118 two mounting holes
120 receiving holes
120*a* first circular pattern
120*b* second circular pattern
120*c* third circular pattern
120*d* fourth circular pattern
130 decorations
132 flexible plastic mesh material
132*r* roll of flexible plastic mesh material
133 first portion
134 unrolled portion
138 separate pieces of predetermined length
138*v* vertex
138*c* oriented concave side
138*s* two parallel side edges
139 mesh material petal
140 flexible securing members
142 serrated elongate tail
143 serrations
144 head
146 tail-receiving aperture
148 serration-engaging tooth
150 clothes pins
160 measuring tool
162 scissors
170 disc
172 hot melt adhesive
174 hot melt adhesive gun
"C" centre point
"F" first radially aligned row pattern
"S" second radially aligned row pattern
200 frame-based decorative article
200*w* wreath
206 hanging member
210 frame
211 first decoration-receiving face
212 second decoration-receiving face
213 main body
214 circular peripheral edge
218 two mounting holes
220 receiving holes
220*a* first circular pattern
220*b* second circular pattern
220*c* third circular pattern
220*d* fourth circular pattern
220*e* fifth circular pattern
230 decorations
240 flexible securing members
"C" centre point

DETAILED DESCRIPTION OF THE ILLUSTRATED EMBODIMENTS

Figure 59:
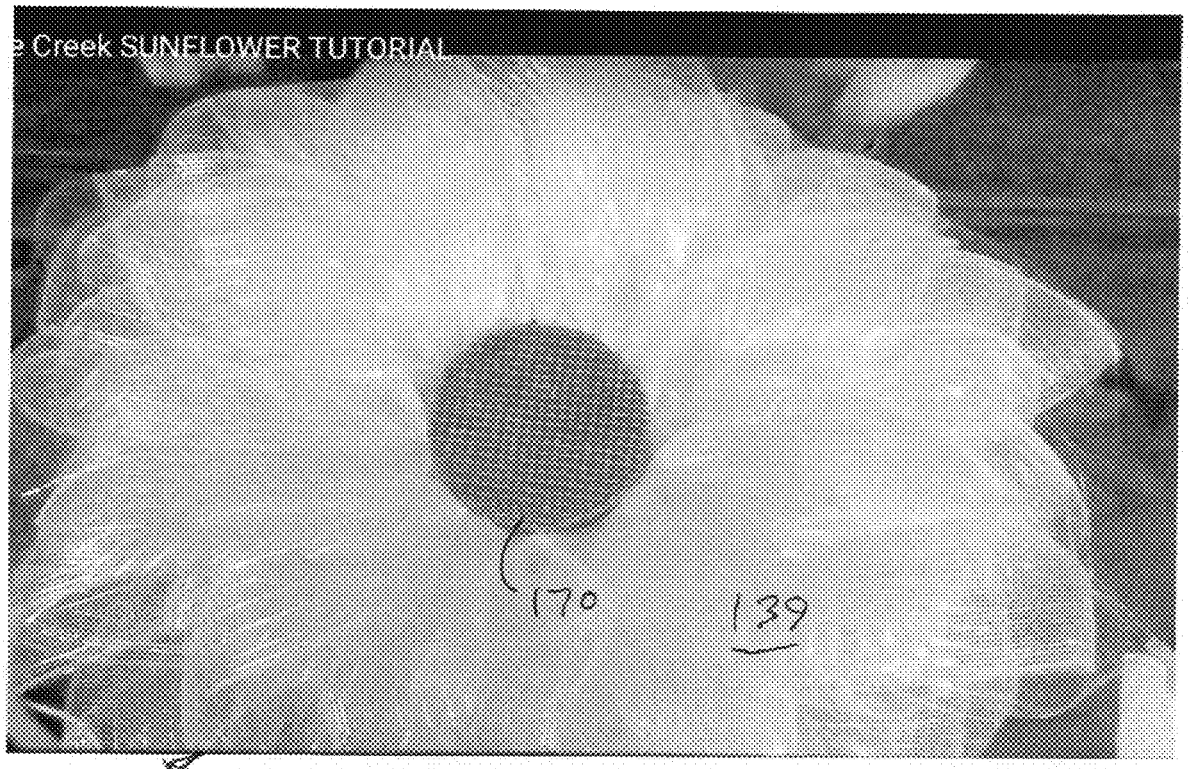
FIG. 59 is a diagrammatic view showing the finished first illustrated embodiment frame-based decorative article.
Figure 60:
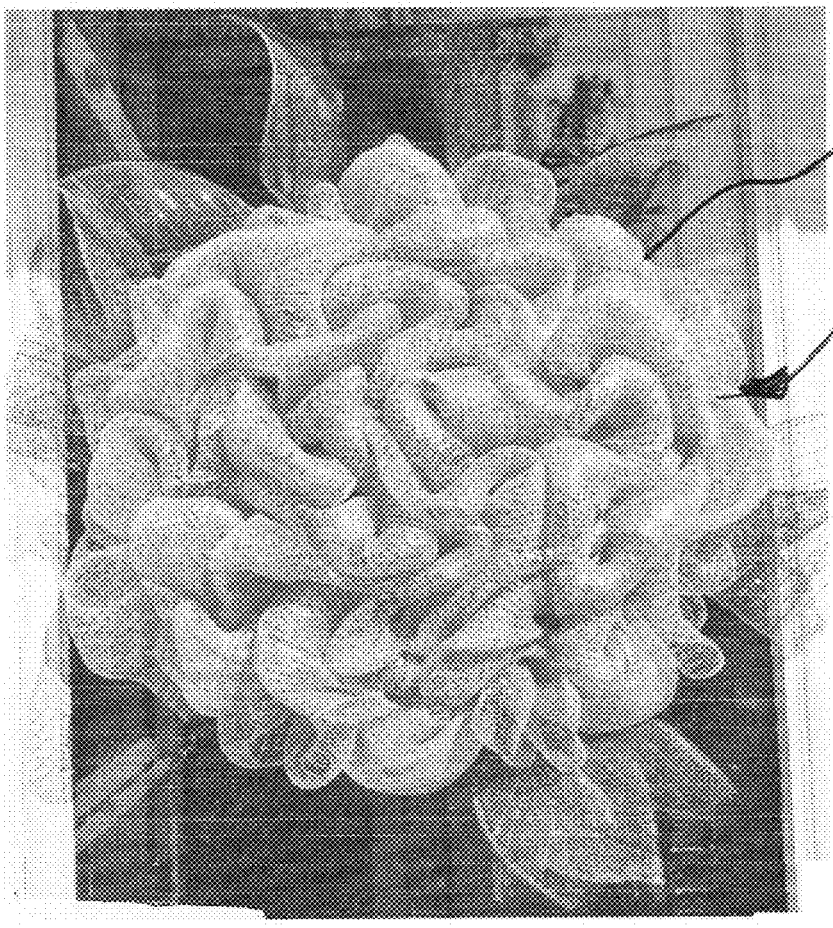
FIG. 60 is a front view of the second illustrated embodiment frame-based decorative article according to the present invention hanging on a door; and, FIG. 61 is a back view of the of the second illustrated embodiment frame-based decorative article of FIG. 60.
Figure 61:
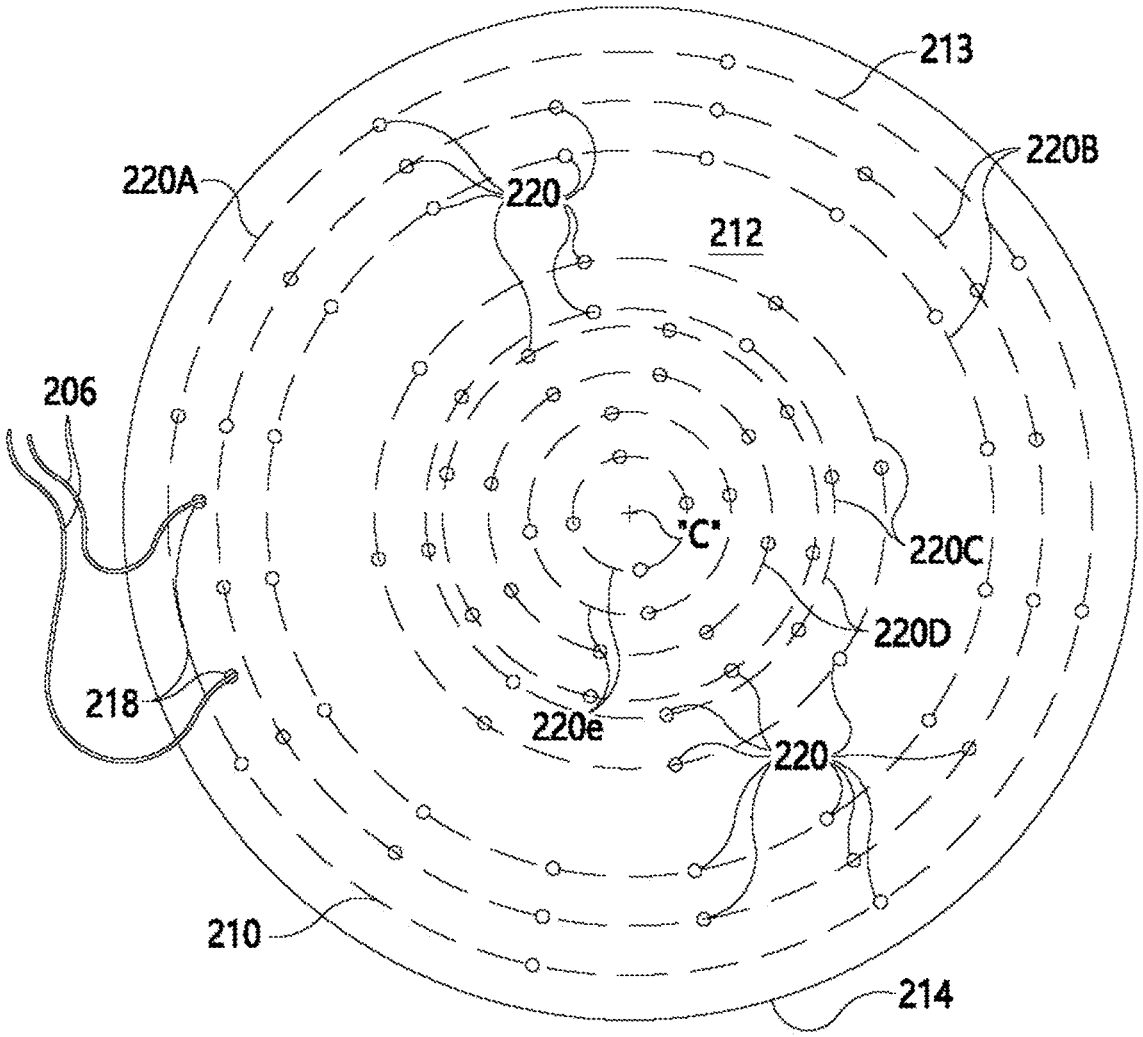

Referring to FIGS. 1 through 61 of the drawings, it will be noted that FIGS. 1 through 59 show a first illustrated embodiment of the frame-based decorative article according to the present invention, and FIGS. 60 and 61 illustrate a second illustrated embodiment of the frame-based decorative article according to the present invention.

Reference will now be made to FIGS. 1 through 59, which show a first illustrated embodiment of the present invention. In brief, the first illustrated embodiment of the present invention comprises a frame-based decorative article, as indicated by the general reference numeral 100. In the first illustrated embodiment, the frame-based decorative article 100 comprises a wreath 100*w* that would typically be hung on a door 104 or a wall (not specifically shown), and the frame 110 comprises a wreath frame 110*w*, and is shown assembled in FIGS. 1 through 5 and FIG. 59. Similarly, the frame-based decorative article 100 could comprise a table decoration or the like.

In brief, the frame-based decorative article 100 comprises a frame 110, a plurality of receiving holes 120 in the frame 110, a plurality of decorations 130 to be secured to the frame 110, and a plurality of flexible securing members 140 for securing the decorations 130 to the frame 110.

Reference will now be made to FIGS. 1 through 59, which show the first illustrated embodiment of the frame-based decorative article 100 according to the present invention.

The frame 110 is circular in shape, as shown, but could be any suitable perimeter shape. Also, the frame 110 is substantially planar as shown, but could be any suitable front-to-back shape.

The frame 110 has a first decoration-receiving face 111 and a second decoration-receiving face 112. As illustrated, the first decoration-receiving face 111 and the second decoration-receiving face 112 each face away one from the other. Further, the first decoration-receiving face 111 and the second decoration-receiving face 112 are each substantially planar and are substantially parallel one to the other.

As can be readily seen in the Figures, the plurality of receiving holes 120 in the frame 110 are arranged in a regular pattern and are arranged as pairs of receiving holes 120. The flexible securing members 140 extend through the pair of receiving holes 120. Further, as illustrated, the pair of receiving holes 120 are substantially radially aligned with a pattern centre point "C" and are regularly angularly spaced around the frame 110. Further, as illustrated, the receiving holes 120 are arranged in at least one circle around the pattern centre point "C", and in the first illustrated embodiment of the present invention, the receiving holes 120 are arranged in a plurality of substantially concentric circles around the pattern centre point "C", specifically four substantially concentric circles of receiving holes 120 around the pattern centre point "C". More specifically, the circular patterns of receiving holes 120 are arranged as follows. A first circular pattern 120*a* of receiving holes 120 is adjacent and immediately inward from the circular peripheral edge 114 of the frame 110. A second circular pattern 120*b* of receiving holes 120 is adjacent and immediately inward from the first circular pattern 120*a* of receiving holes 120. A third circular pattern 120*c* of receiving holes 120 is adjacent and immediately inward from the second circular pattern 120*b* of receiving holes 120. A fourth circular pattern 120*d* of receiving holes 120 is adjacent and immediately inward from the third circular pattern 120*d* of receiving holes 120 and also adjacent and immediately inward from the central inner core area 116 of the frame 110.

It should be understood that the above-described pattern of receiving holes is merely one example of a possible pattern of receiving holes that may be used as part of the present invention. Other regular or irregular patterns of receiving holes could also be used.

The present invention also comprises a plurality of decorations 130 to be secured to the frame 110. The decorations 130 are made from a thin sheet of flexible plastic material that in the illustrated embodiment comprises a suitable flexible plastic mesh material 132. The flexible plastic mesh material 132 is readily available on a roll of flexible plastic mesh material 132*r* that typically would comprise several meters of material. As can be readily seen, the decorations 130 comprise petals in order to cause the decorative article, which in the first illustrated embodiment is a wreath 100*w*, to nicely resemble a flower. As will be discussed in greater detail subsequently, the petals are tied by a flexible securing member 140 so as to have a central constricted portion and two petal portions. For the sake of convenience, the petals are tied by the same flexible securing members 140 that secures them to the frame 110.

The plurality of flexible securing members 140 are for securing the decorations 130 to the frame 110. The plurality of flexible securing members 140 extend through a selected pair of receiving holes 120 in the frame 110 and surround a portion of at least one of the decorations 130 and the portion of the frame 110 between the two receiving holes 120, to thereby secure the plurality of decorations 130 one adjacent others in outwardly projecting relation on the frame 110. The decorations 130 may be secured by the flexible securing members 140 on at least one of the first decoration-receiving face 111 and the second decoration-receiving face 112 of the frame 110. As illustrated, the decorations 130 are secured by the flexible securing members 140 on one of the first decoration-receiving face 111 and the second decoration-receiving face 112 of the frame 110.

Figure 10:
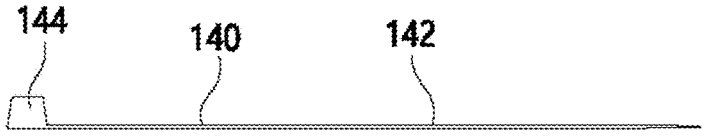
FIG. 10 is a top plan view of one of the flexible securing members used in the construction of the first illustrated embodiment frame-based decorative article of FIG. 1.
Figure 11:
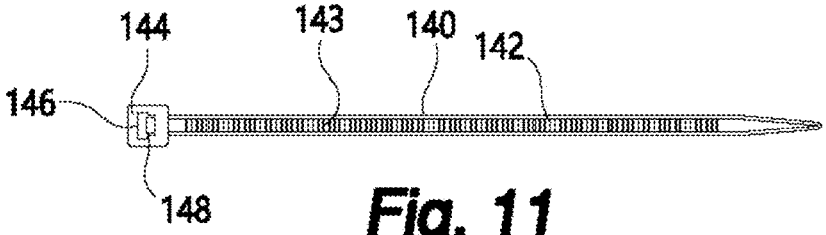
FIG. 11 is a side elevational view of one of the flexible securing members used in the construction of the first illustrated embodiment frame-based decorative article of FIG. 1.
Figure 12:
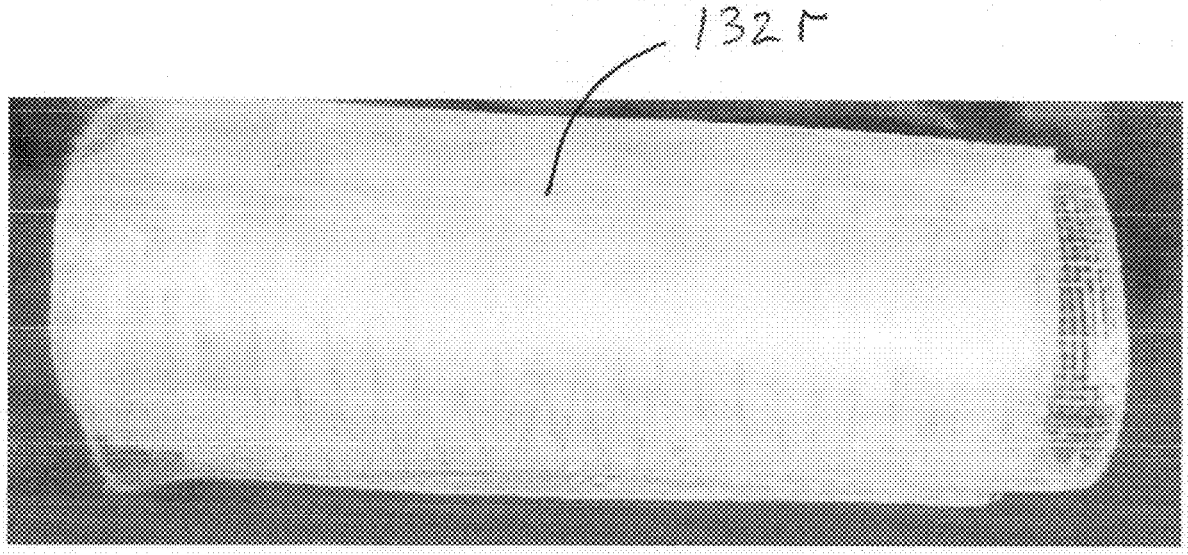
FIG. 12 is a side view of a roll of the flexible plastic mesh material used to make the petals used in the construction of the first illustrated embodiment frame-based decorative article of FIG. 1.
Figure 13:
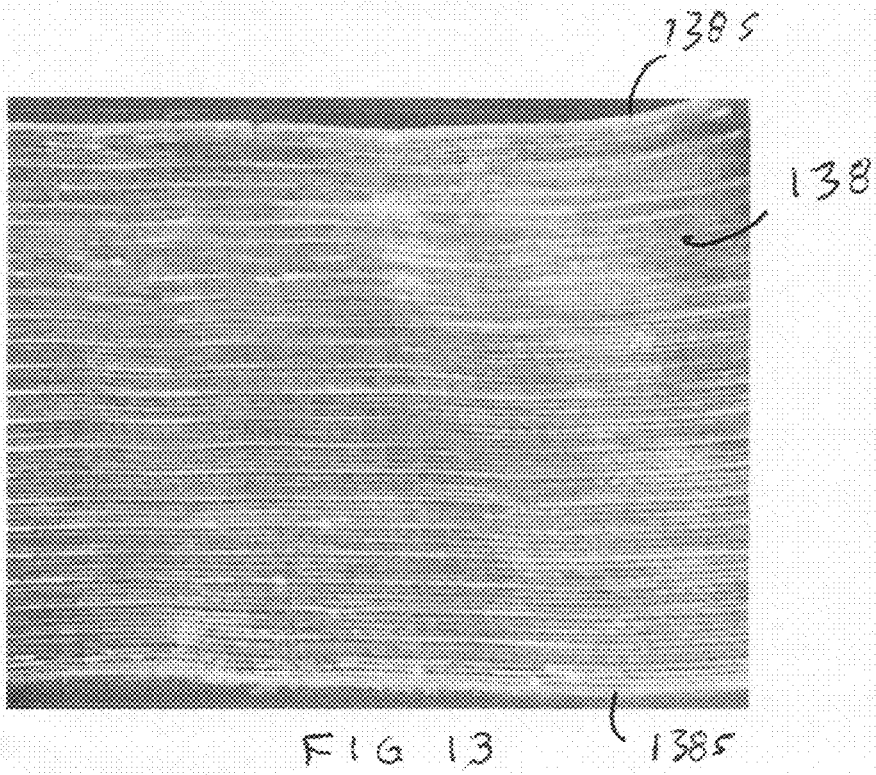
FIG. 13 is a front view of cut pieces of the petal material used in the construction of the first illustrated embodiment frame-based decorative article of FIG. 1.
Figure 14:
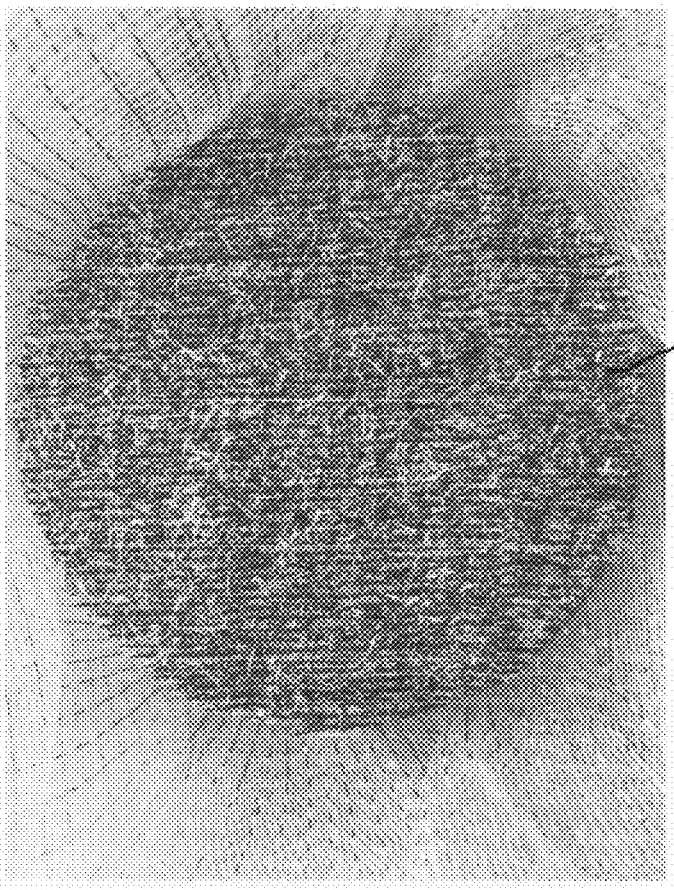
FIG. 14 is a front view of the centre piece used in the construction of the first illustrated embodiment frame-based decorative article of FIG. 1.
Figure 15:
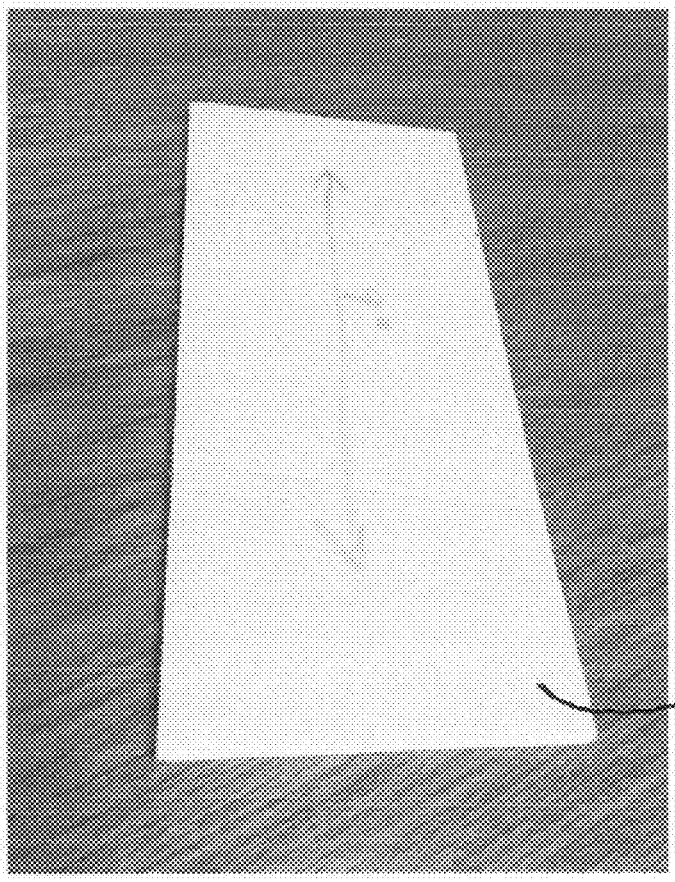
FIG. 15 is a perspective view of the measuring tool used to help construct the first illustrated embodiment frame-based decorative article of FIG. 1.
Figure 16:
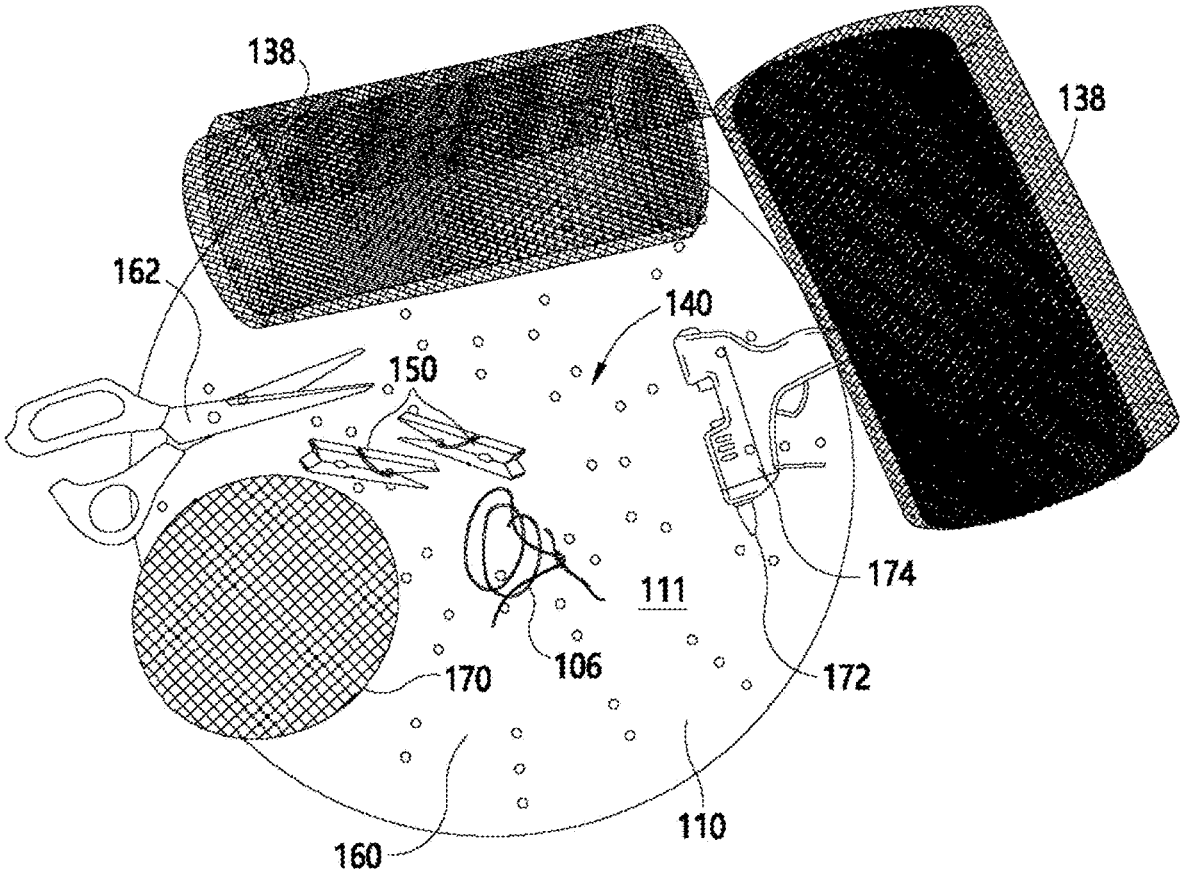
FIG. 16 is a diagrammatic view of the various components of the first illustrated embodiment frame-based decorative article of FIG. 1, with the first illustrated embodiment frame-based decorative article about to be assembled using the tools that are also shown.

As can be readily seen in FIGS. 10 and 11, flexible securing members 140 are made from flexible plastic, and have a serrated elongate tail 142 and a head 144 with a tail-receiving aperture 146. A serration-engaging tooth 148 is situated at the tail-receiving aperture 146 so as to engage the serrations 143 of the serrated elongate tail 142. More specifically, the serration-engaging tooth 148 are disposed within the head 144 of the flexible securing member 140 and are oriented inwardly towards the tail-receiving aperture 146 for engaging the serrations 143 of the serrated elongate tail 142 in securing relation. This specific configuration of flexible securing member 140 is commonly referred to as a cable tie or a zip tie, among other terms.

The frame-based decorative article 100 also has a hanging member 106 to permit the frame-based decorative article 100 to be hung from a door 104, a wall, or the like. As illustrated, the hanging member 106 comprises a piece of string extending through two mounting holes 118 in the frame 110 adjacent the top of the frame 110.

In another aspect, the present invention comprises a frame 110 for use in forming a frame-based decorative article 100. The frame 110 comprises a main body 113 with a plurality of receiving holes 120 in the main body 113. As illustrated, the main body 113 is substantially planar. Other suitable shapes could also be used. The receiving holes 120 are arranged in the first circular pattern 120*a*, the second circular pattern 120*b*, the third circular pattern 120*c*, and the fourth circular pattern 120*d*. The first circular pattern 120*a*, the second circular pattern 120*b*, the third circular pattern 120*c*, and the fourth circular pattern 120*d* are generally concentric one with the other about the centre point "C". Further, the frame 110 also comprises the central inner core area 116 inside the fourth circular pattern 120*d* of circular holes 120.

The receiving holes 120 are also arranged in radially aligned rows, with at least some of the receiving holes 120 in the radially aligned rows being generally arranged in radially aligned pairs of receiving holes 120. As can be seen in the Figures, the radially aligned rows of receiving holes 120 comprise a first radially aligned row pattern "F" of receiving holes 120 and a second radially aligned row pattern "S" of receiving holes 120. The first radially aligned row pattern "F" of receiving holes 120 and the second radially aligned row pattern "S" of receiving holes 120 are different one pattern from the other pattern. In the first radially aligned row pattern "F" of receiving holes 120, there are receiving holes 120 disposed at the first circular pattern 120*a* of receiving holes 120, the second circular pattern 120*b* of receiving holes 120, and the fourth circular pattern 120*d* of receiving holes 120. In the second radially aligned row pattern "S" of receiving holes 120, there are receiving holes 120 disposed at the second circular pattern 120*b* of receiving holes 120 and the third circular pattern 120*c* of receiving holes 120. Use of this pattern allows for the creation of several different styles of wreaths from one style of frame 110.

Reference will now be made to FIGS. 17 through 59, which show the method of assembling a frame-based decorative article 100 according to the present invention, wherein the frame 110 has a plurality of receiving holes 120, a plurality of decorations 130, and plurality of flexible securing members 140. The method basically comprises the steps of (a) placing a decoration 130 on the frame 110; (b) surrounding a flexible securing member 140 around a portion of the placed decoration 130 and a portion of the frame 110; (c) closing the flexible securing member 140 to a decoration-retaining configuration around the surrounded portion of the decoration 130 and the surrounded portion of the frame 120, to thereby secure the decoration 130 in outwardly projecting relation onto the frame 110; and (d) repeating steps (a) through (c) to thereby secure the plurality of decorations 130 one adjacent others in outwardly projecting relation on the frame 110. The steps do not need to be done in the order as stated above. Any suitable order of the steps can be used.

More specifically, the method of assembling a frame-based decorative article 100 according to the present invention may comprise the following steps as set forth with reference to the associated Figures.

Figure 17:
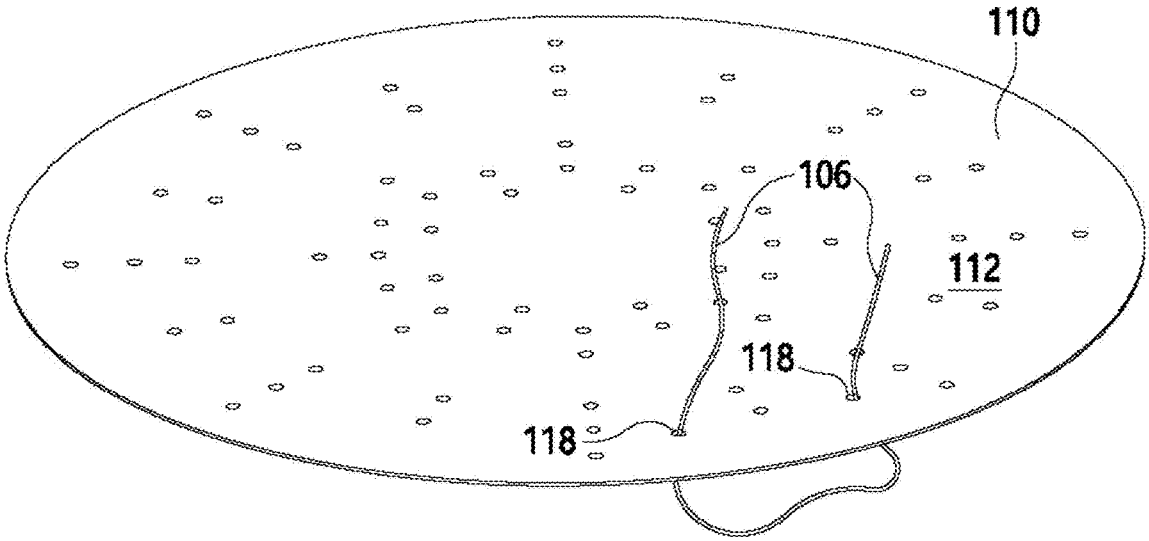
FIG. 17 is a diagrammatic view of the hanging string being inserted into the two string-receiving holes in the frame.
Figure 18:
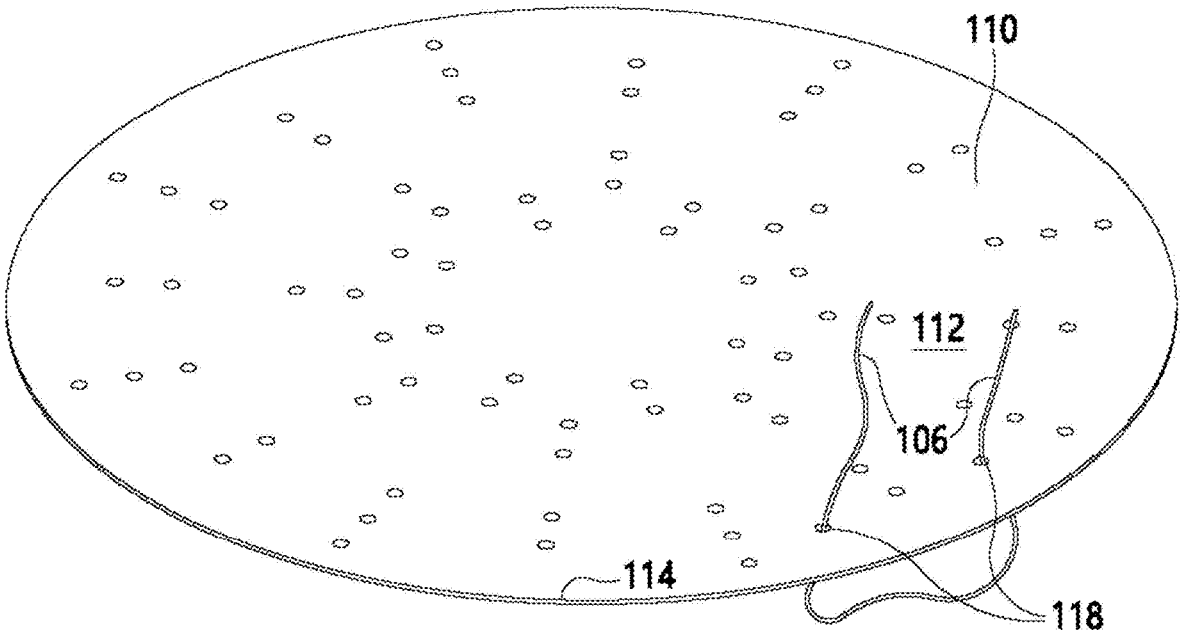
FIG. 18 is a diagrammatic view of the hanging string being tied.

As can be seen in FIG. 17, the hanging string may be inserted into the two string-receiving holes 120 and then subsequently tied, as shown in FIG. 18, preferably with a double knot tied in order to form a looped hanging string. Preferably, the knot is tied at the one of the first decoration-receiving face 111 and the second decoration-receiving face 112 that will face towards the door 104 or wall upon which the frame-based decorative article 100 is hung from.

Figure 19:
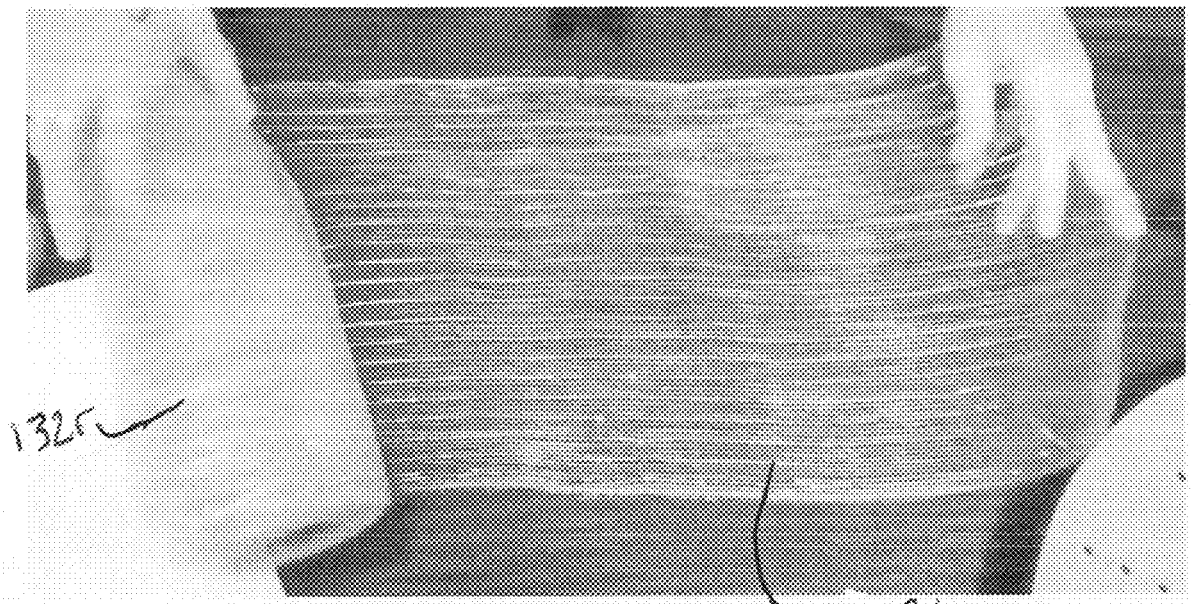
FIG. 19 is a diagrammatic view of the roll of flexible plastic mesh material being unrolled somewhat.
Figure 20:
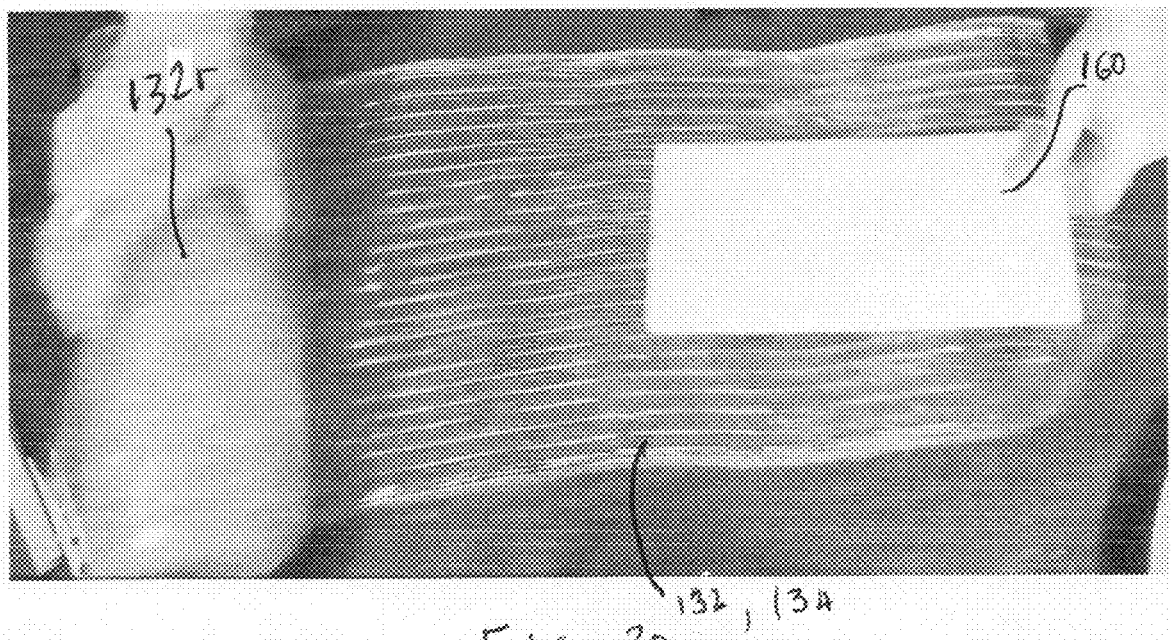
FIG. 20 is a diagrammatic view of the measuring tool being placed on the unrolled portion of the flexible plastic mesh material.
Figure 21:
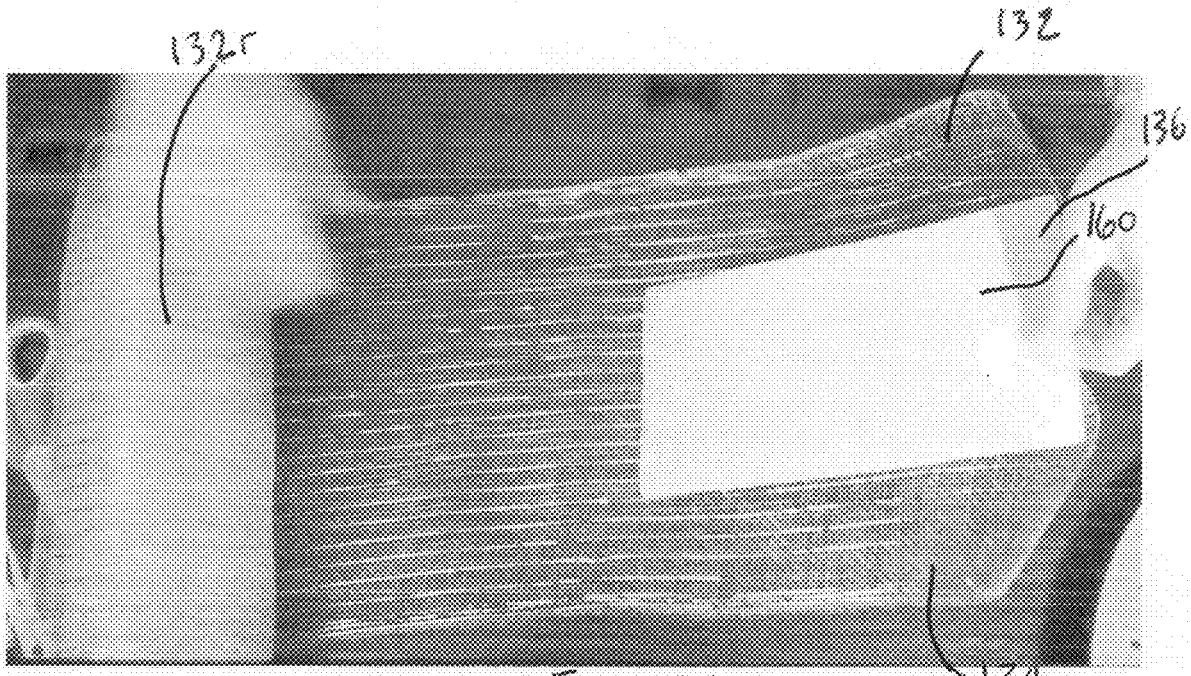
FIG. 21 is a diagrammatic view of the end of the unrolled portion of the flexible plastic mesh material being bent over the end of the measuring tool.
Figure 22:
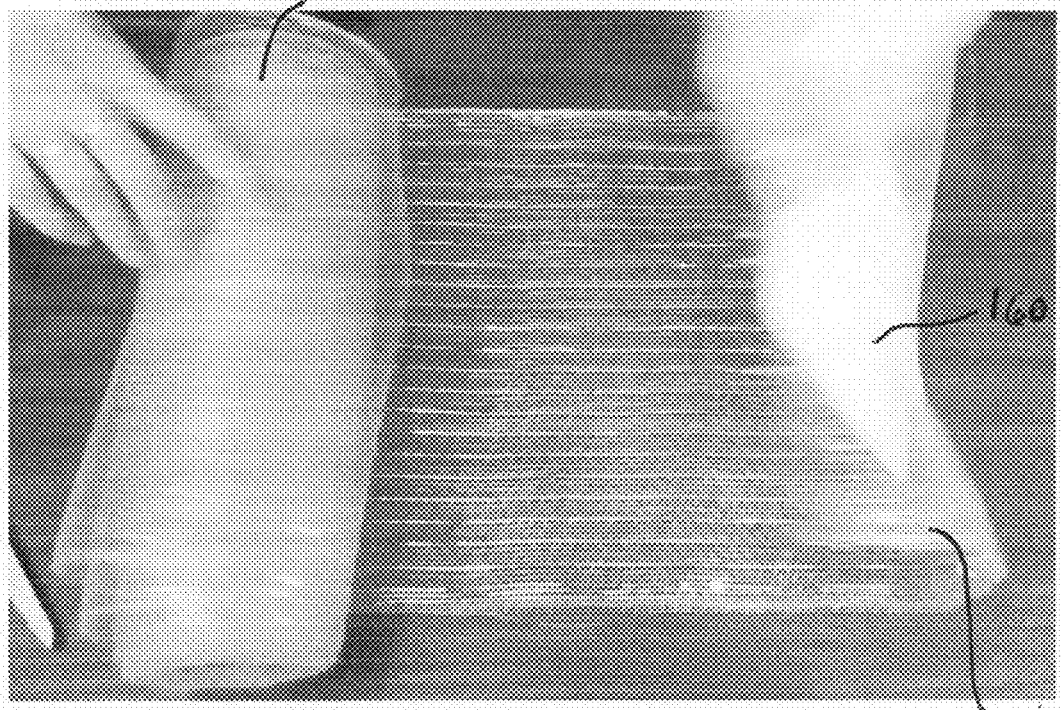
FIG. 22 is a diagrammatic view of a person grasping the flexible plastic mesh material and one end of the measuring tool and flipping over the measuring tool onto the adjacent flexible plastic mesh material.
Figure 23:
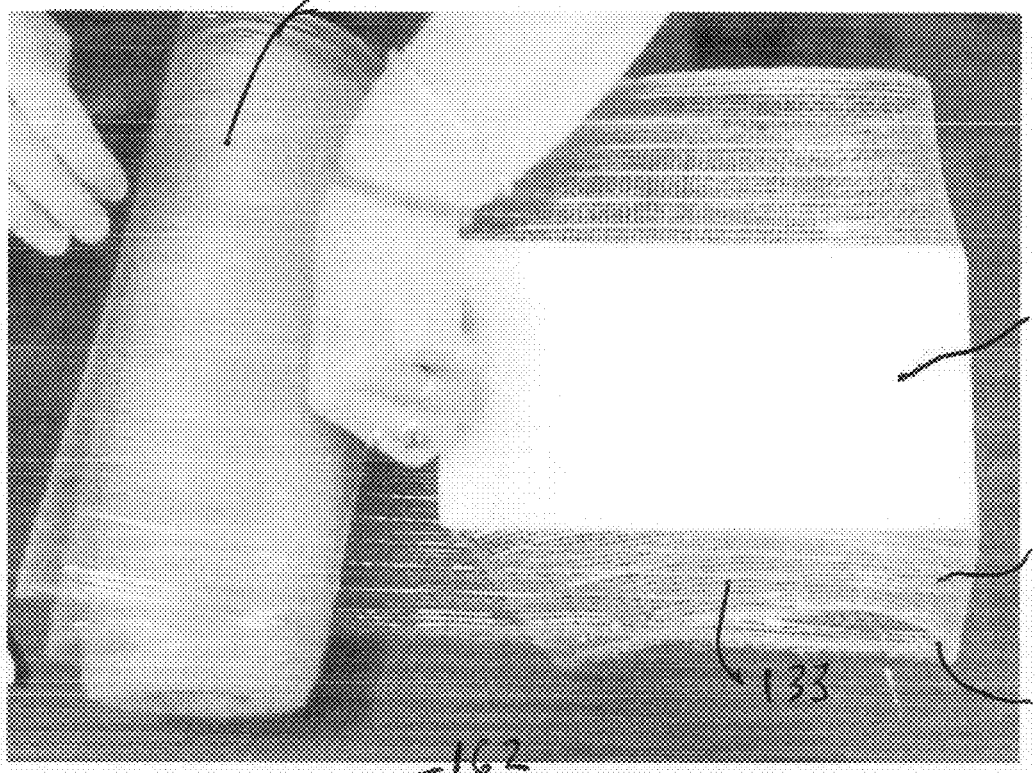
FIG. 23 is a diagrammatic view of the first portion of the flexible plastic mesh material and the measuring tool flipped over onto the adjacent portion of the flexible plastic mesh material.
Figure 24:
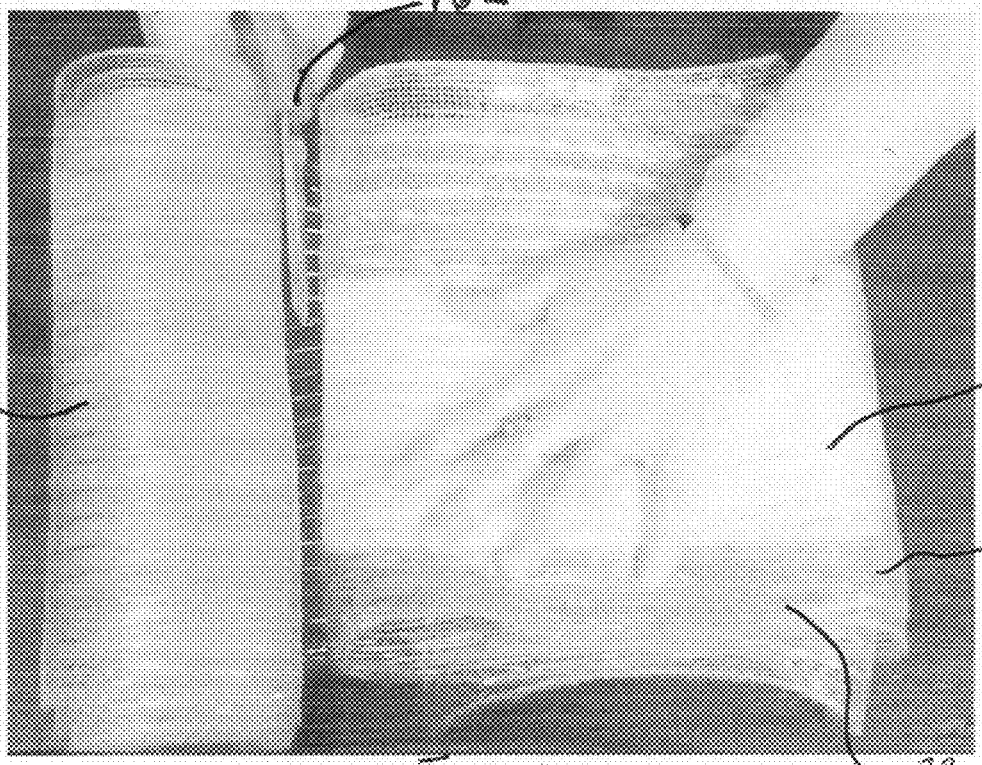
FIG. 24 is a diagrammatic view of the folded portions of the flexible plastic mesh material that are wrapped around the measuring tool being cut from the remaining roll of the flexible plastic mesh material.
Figure 25:
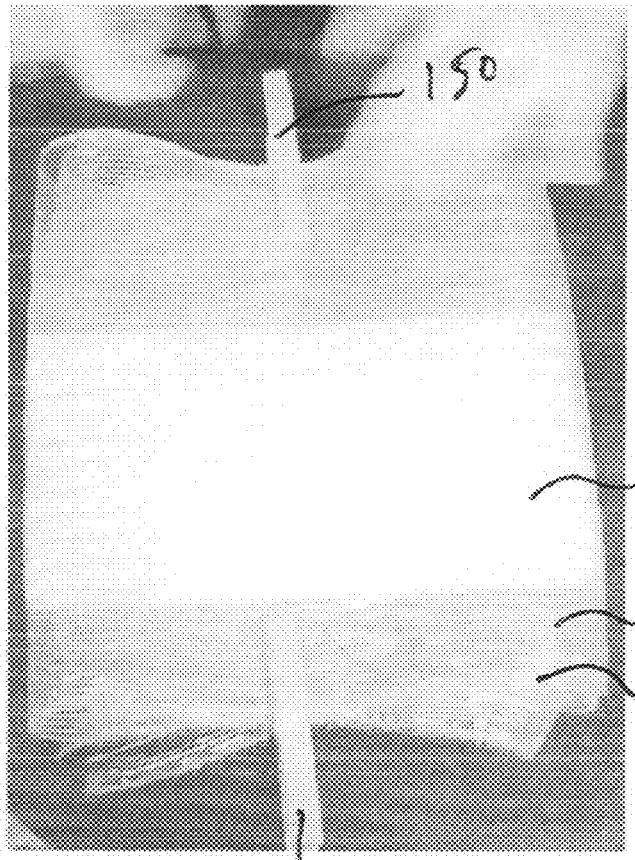
FIG. 25 is a diagrammatic view of the folded portions of the flexible plastic mesh material being clamped with clothes pins.
Figure 26:
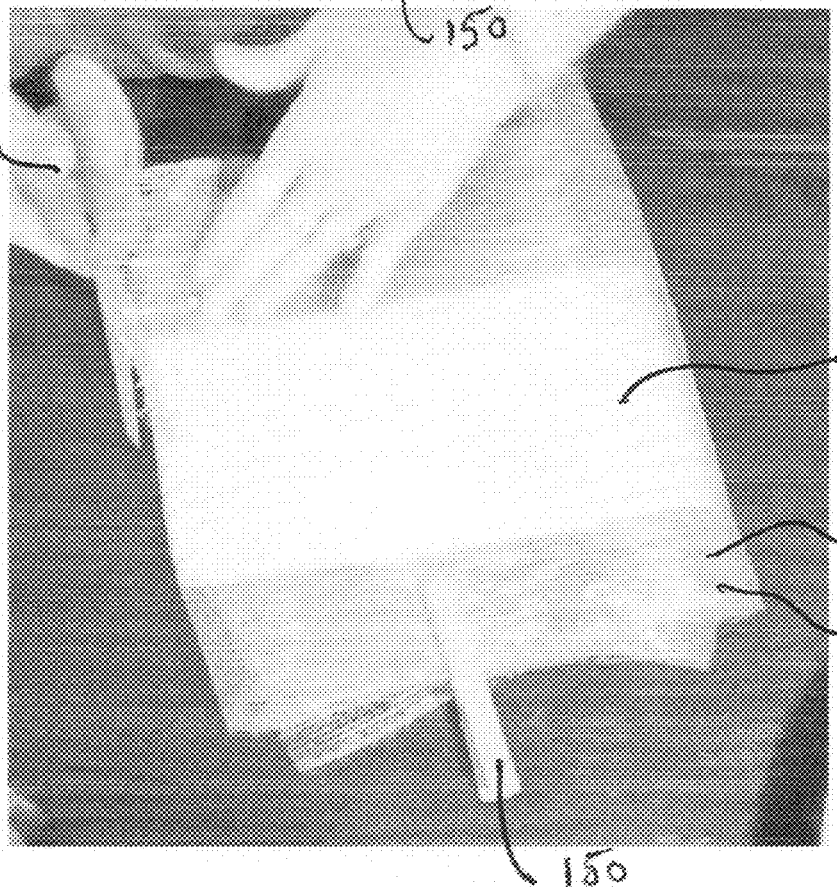
FIG. 26 is a diagrammatic view of the first set of folded ends of the folded portions of the flexible plastic mesh material being cut.
Figure 27:
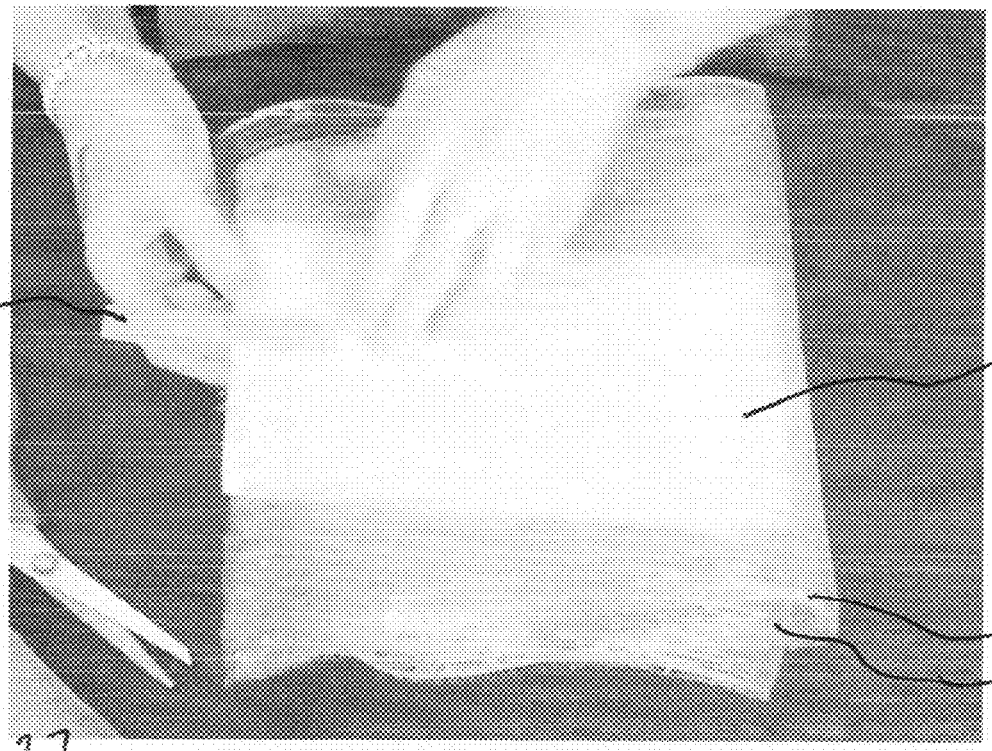
FIG. 27 is a diagrammatic view of one of the clothespins being moved to clamp the cut ends of the flexible plastic mesh material onto the measuring tool.
Figure 28:
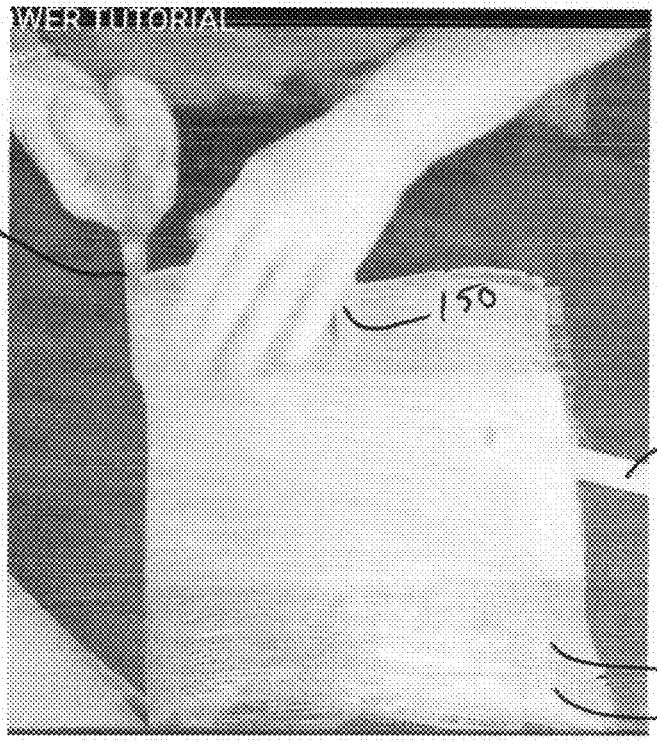
FIG. 28 is a diagrammatic view of the second set of folded ends of the folded portions of the flexible plastic mesh material being cut.
Figure 29:
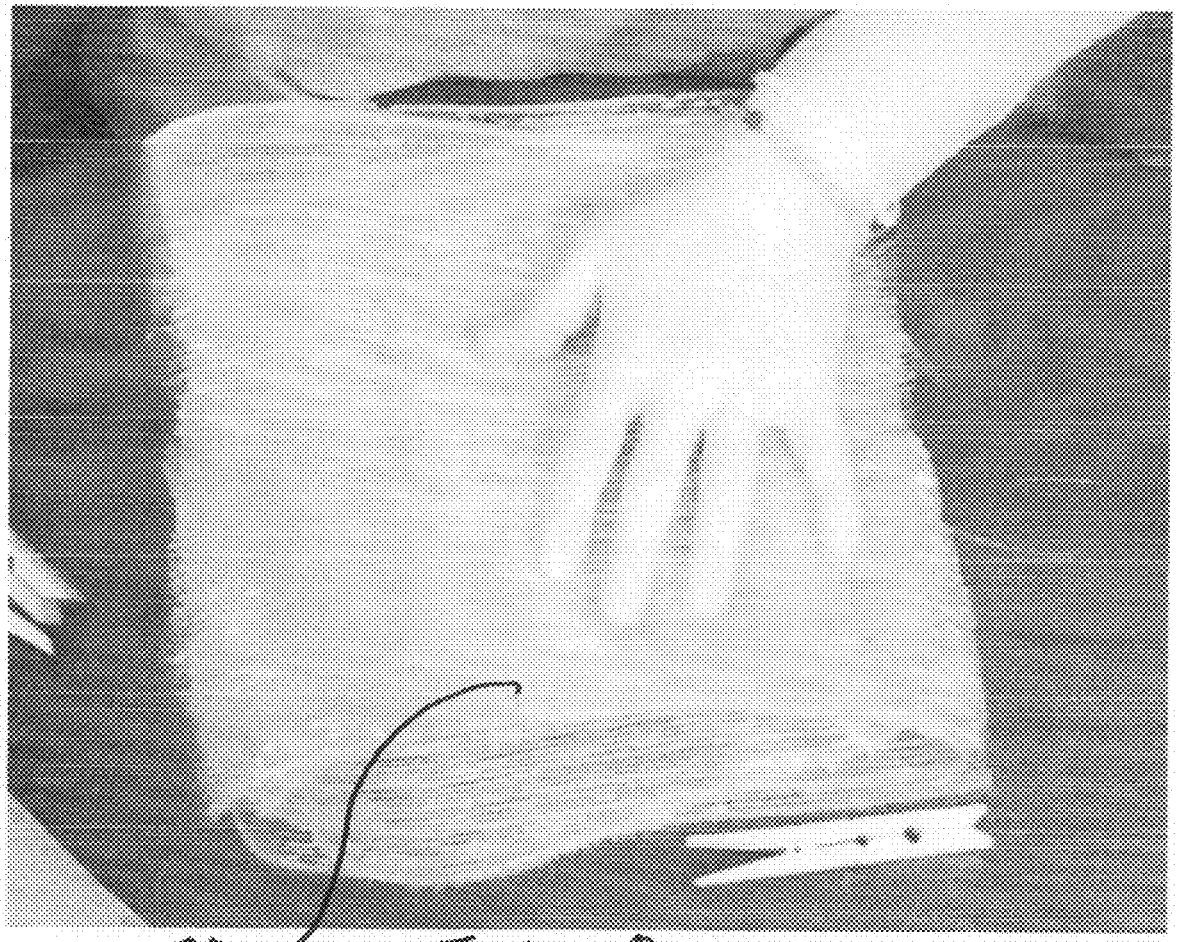
FIG. 29 is a diagrammatic view of several pieces of flexible plastic mesh material cut to the length of the measuring tool.

The roll 132*r* of flexible plastic mesh material 132 is unrolled slightly, as shown in FIG. 19, and the measuring tool 160 is placed on the unrolled portion 134 of the mesh material, as shown in FIG. 20. As can be seen in FIG. 21, the end portion 136 of the unrolled portion 134 of the flexible plastic mesh material 132 is bent over the end of the measuring tool 160, and the flexible plastic mesh material 132 and one end of the measuring tool 160 are grasped and flipped over the measuring tool 160 onto the adjacent flexible plastic mesh material 132, as shown in FIG. 22. Next, as seen in FIG. 23, a first portion 133 of the flexible plastic mesh material 132 and the measuring tool 160 flip over onto the adjacent portion of the flexible plastic mesh material 132. This step is repeated until the desired number of sections of the flexible plastic mesh material 132 have been wrapped around the measuring tool 160. It should be understood that the length of the measuring tool 160 is the same as the desired length of cut sections of flexible plastic mesh material 132. Once the desired amount of flexible plastic mesh material 132 has been wrapped around the measuring tool 160, a pair of scissors 162 can be used to cut the folded portions of the flexible plastic mesh material 132 from the remainder of the roll 132*r* of flexible plastic mesh material 132, as can be seen in FIG. 24. As can be seen in FIG. 25, the section of flexible plastic mesh material 132 that is not yet cut into its separate pieces 138 of predetermined length, are clamped to the folded mesh with clothes pins 150 at both of their two parallel side edges 138*s* in order to keep the cut pieces 138 of flexible plastic mesh material 132 aligned with each other during the cutting process. Next, as can be seen in FIG. 26, scissors 162 are used to cut along the first set of folded ends of the folded portions of the flexible plastic mesh material 132, and as seen in FIG. 27, one of the clothes pins 150 is moved and is used to clamp the cut ends of the flexible plastic mesh material 132 onto the measuring tool 160. Next, as seen in FIG. 28, the second set of folded ends of the folded portions of the flexible plastic mesh material 132 are cut along in order to complete the cutting of at least some of the required cut pieces 138 of flexible plastic mesh material 132, as shown in FIG. 29.

Figure 30:
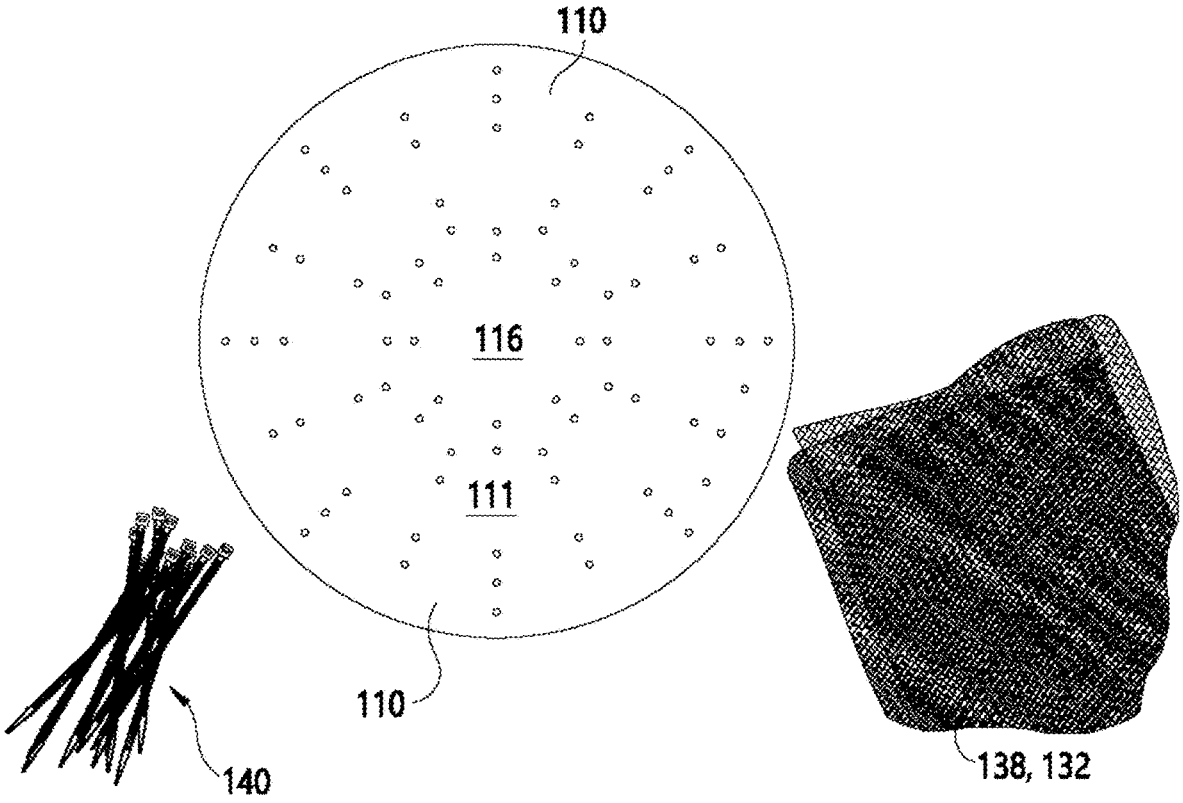
FIG. 30 is a diagrammatic view of the components being readied to subsequently insert the flexible securing members through various ones of the holes in the first illustrated embodiment frame-based decorative article frame.
Figure 31:
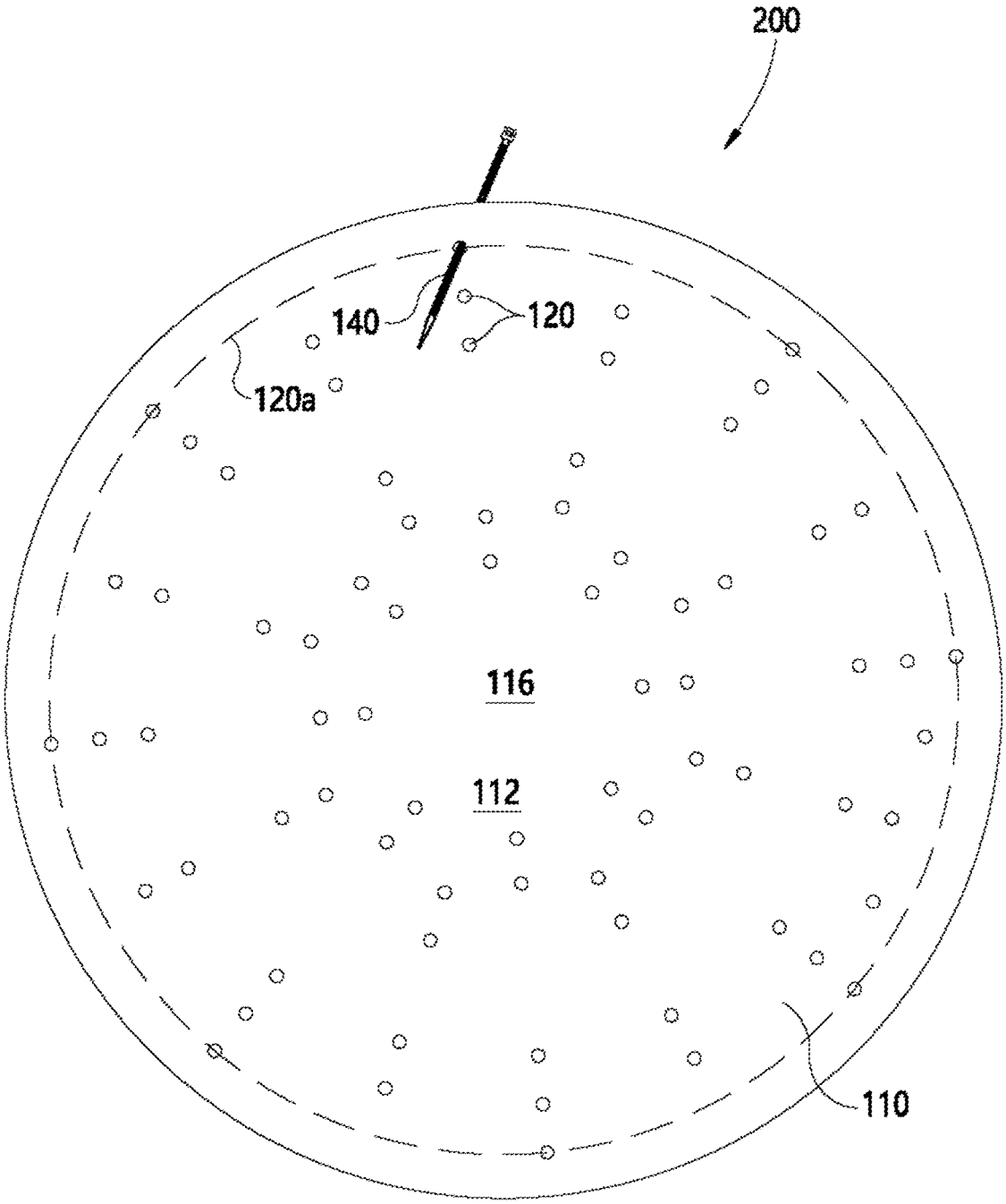
FIG. 31 is a diagrammatic view of the flexible securing members being inserted through various ones of the holes in the frame, specifically into a co-operating pair of receiving holes in the outer perimeter circular row of receiving holes.

FIG. 30 shows the components gathered to start the insertion of the flexible securing members 140 through various ones of the receiving holes 120 in the frame 110. As can be seen in FIG. 31, a flexible securing member 140 is inserted through one of the holes in the frame-based decorative article 100 frame 110. In this case, the selected receiving hole 120 is in the first circular pattern 120*a* of receiving holes 120.

Figure 32:
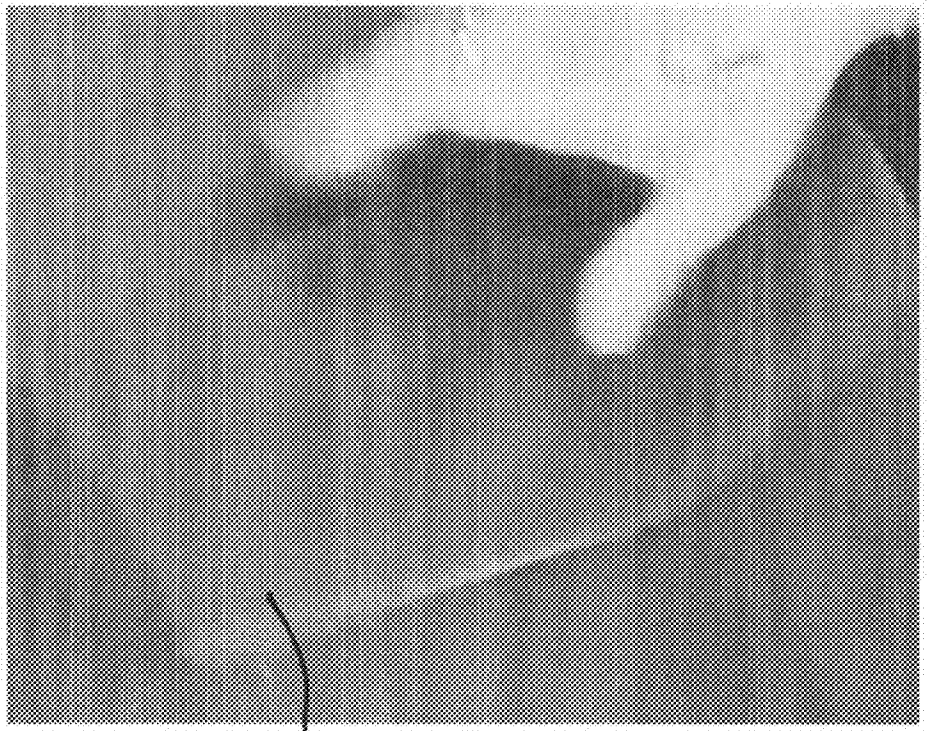
FIG. 32 is a diagrammatic view of a single piece of flexible plastic mesh material.
Figure 33:
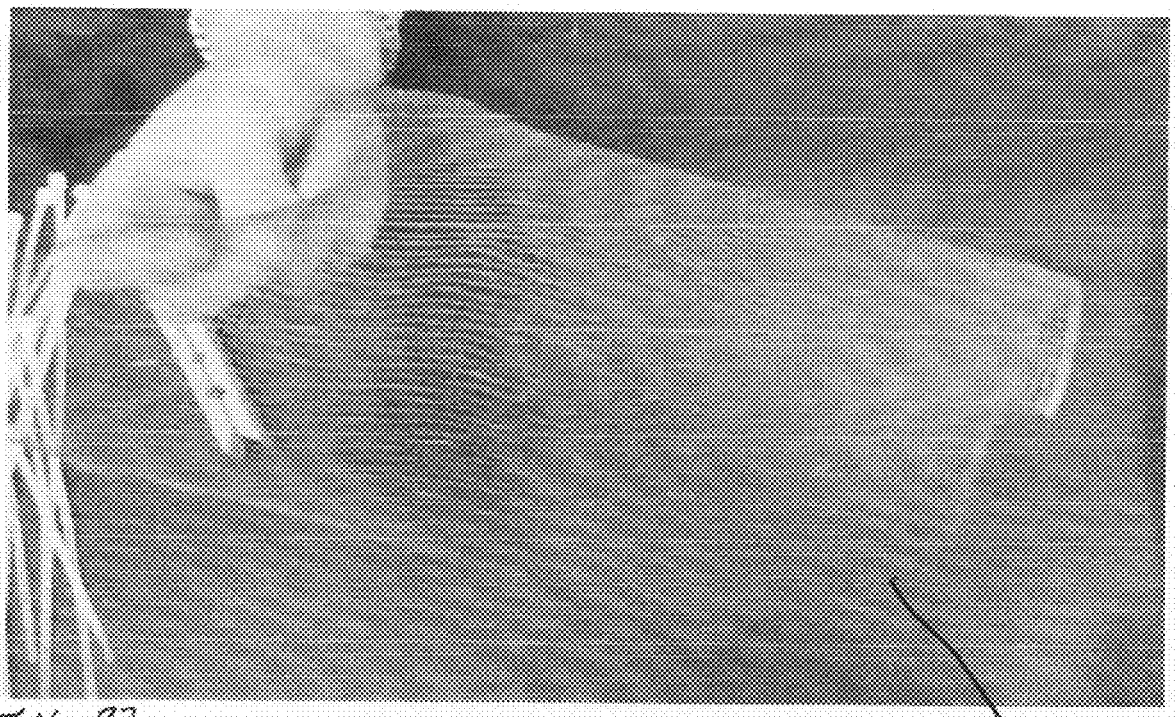
FIG. 33 is a diagrammatic view of the single piece of flexible plastic mesh material with the concave face of the flexible plastic mesh material facing downwardly.
Figure 34:
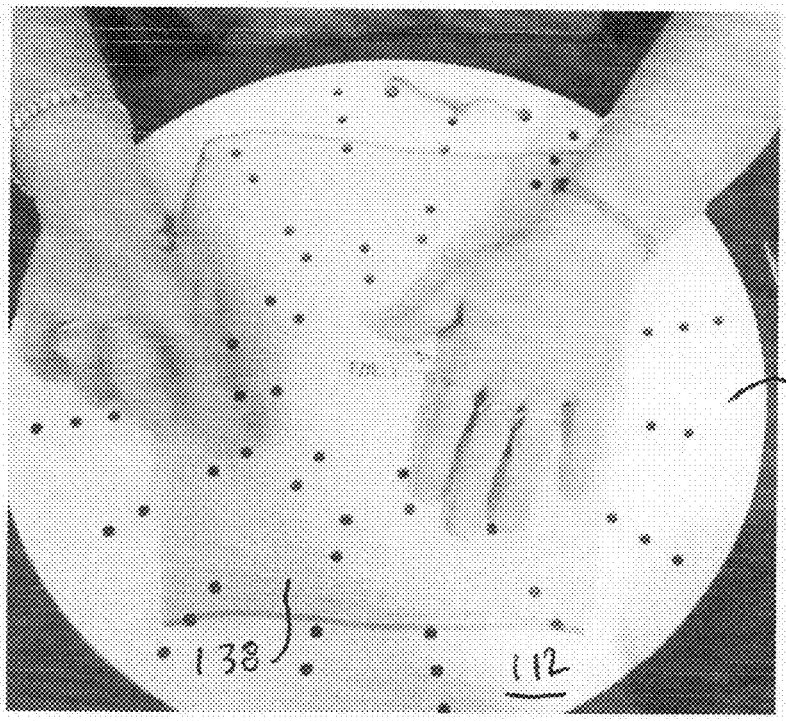
FIG. 34 is a diagrammatic view of the single piece of flexible plastic mesh material being placed onto the frame.

As can be seen in FIG. 32, a single piece 138 of flexible plastic mesh material 132 is taken from the pile of pieces 138 of flexible plastic mesh material 132, and is oriented concave side 138*c* facing downwardly, as best seen in FIG. 33, and placed onto the frame 110, as best seen in FIG. 34.

Figure 39:
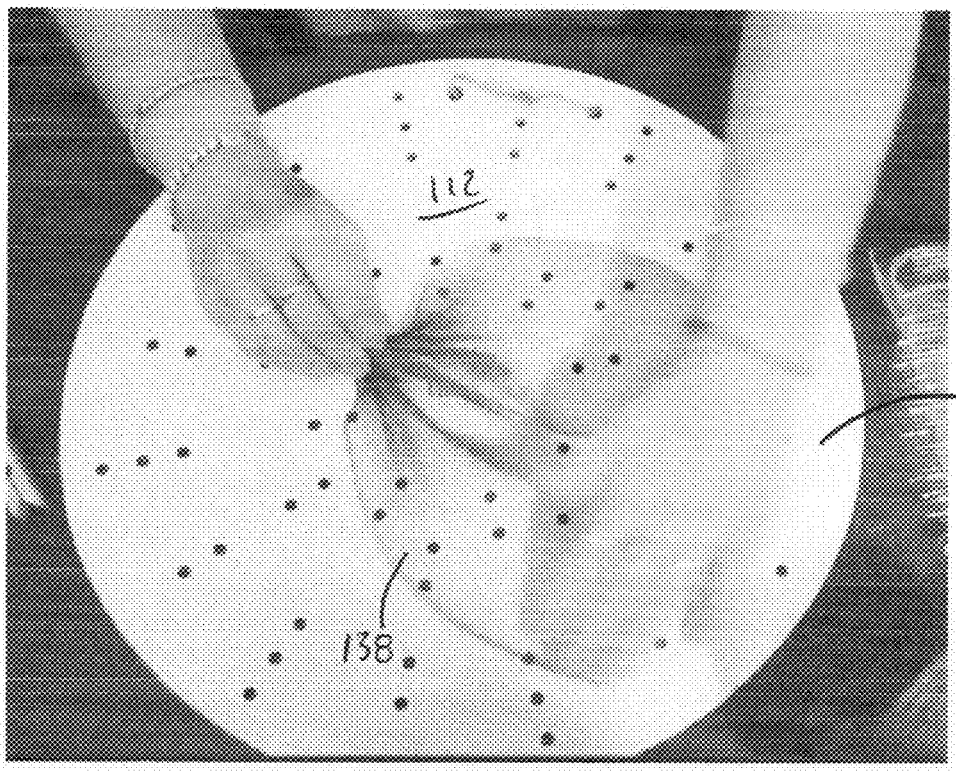
FIG. 39 is a diagrammatic view of the fully scrunched single piece of flexible plastic mesh material being folded into a "C" shape, thereby forming a petal shape, or in other words a mesh material petal.
Figure 40:
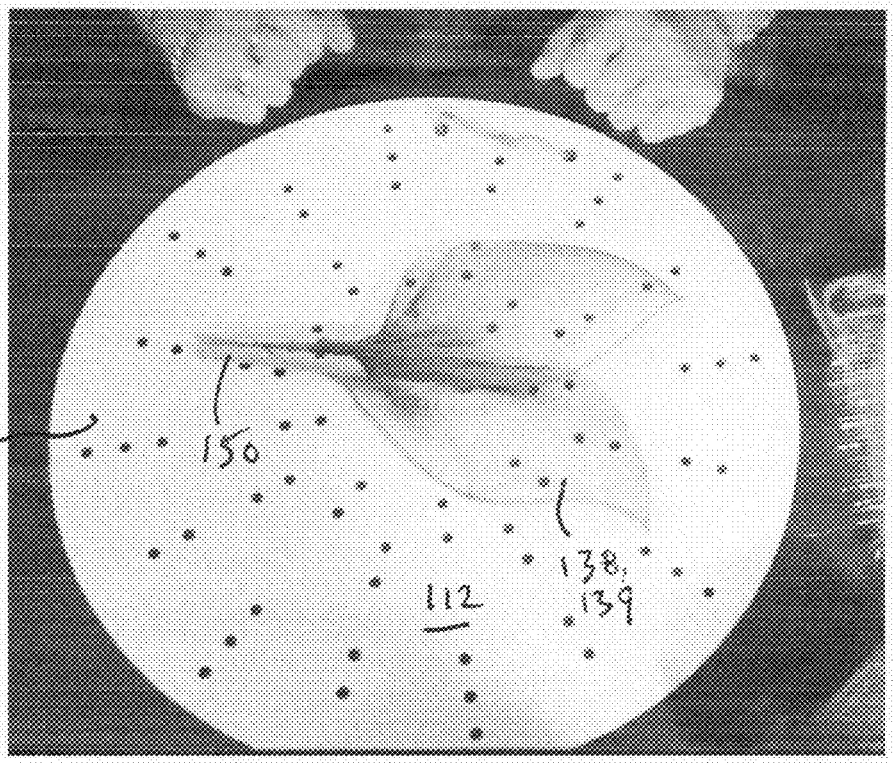
FIG. 40 is a diagrammatic view of a clothes pin clipped onto the mesh material petal.

In order to form the piece 138 of flexible plastic mesh material 132 into a petal shape, one corner of the piece of material is scrunched all of the way to the opposite corner as is shown in FIGS. 35 through 38, and then folded into a "C" shape, as shown in FIG. 39. As can be seen in FIG. 40, one of the clothes pins 150 is used to clip the scrunched piece 138 of flexible plastic mesh material 132 at its vertex 138*v* to form the petal shape, specifically a mesh material petal 139. The clothes pin 150 will be subsequently removed when the mesh material petal 139 is secured to the frame 110.

Figure 41:
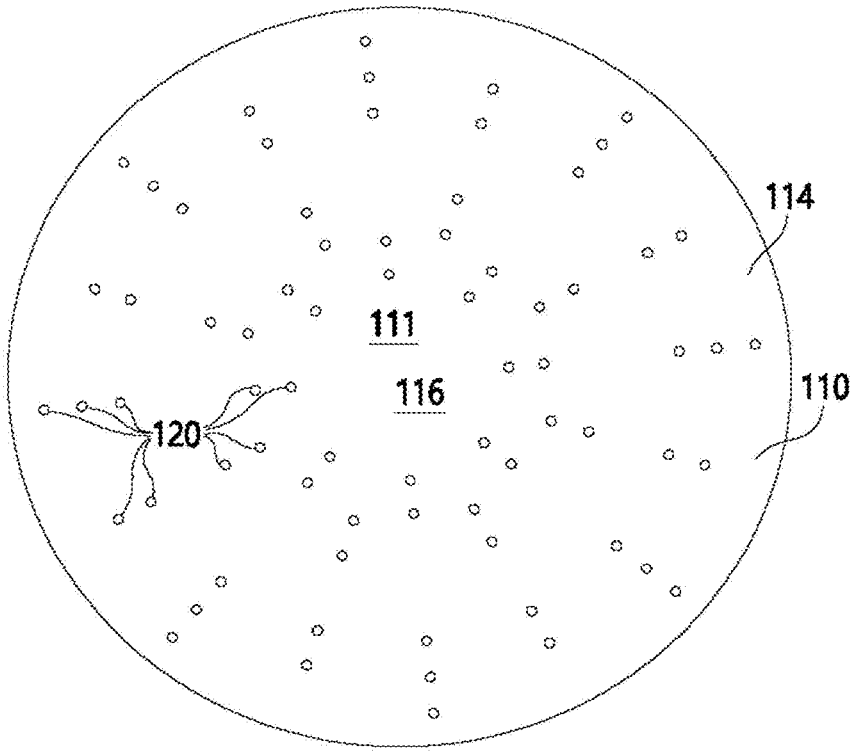
FIG. 41 is a diagrammatic view of the frame with the first decoration-receiving face facing upwardly.
Figure 42:
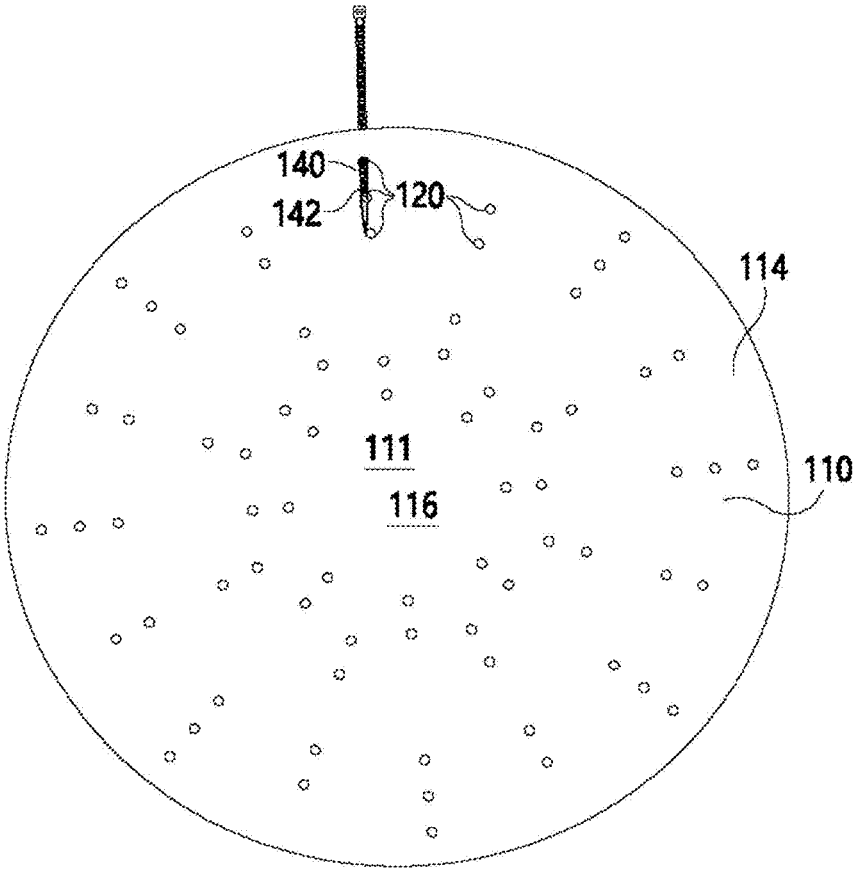
FIG. 42 is a diagrammatic view showing the tail of one of the flexible securing members being inserted into one of the receiving holes of the frame in the row first circular pattern of receiving holes closest to the periphery of the frame.
Figure 43:
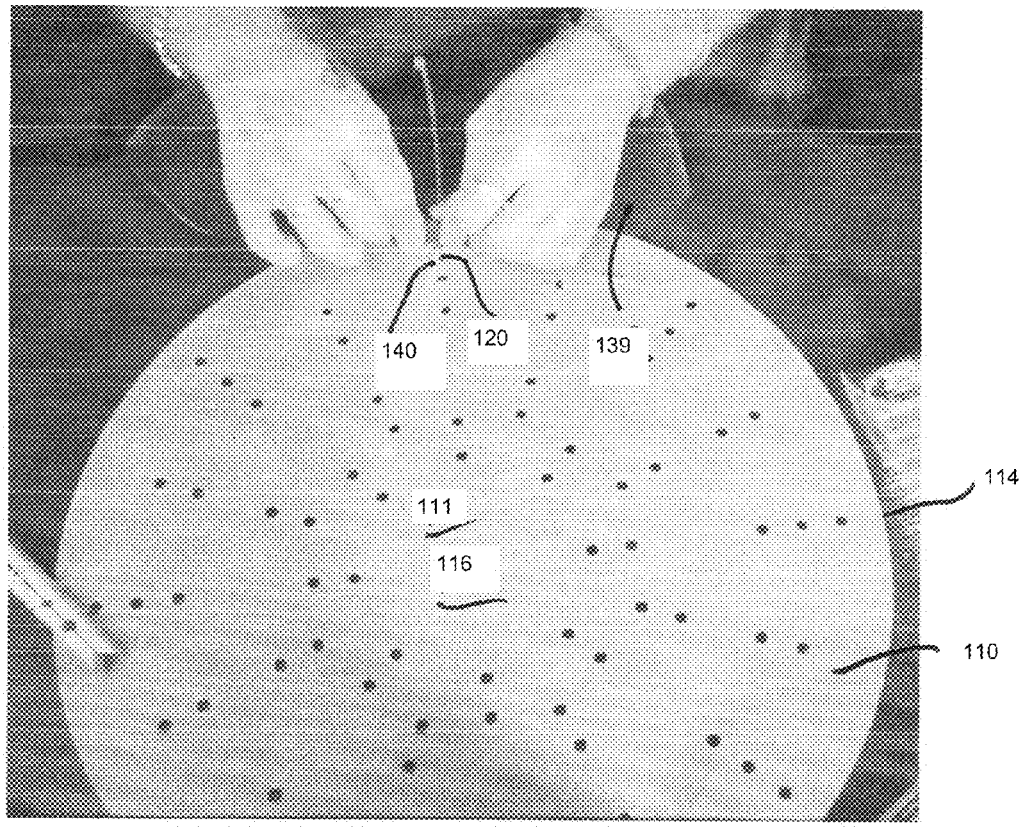
FIG. 43 is a diagrammatic view showing the pinched vertex of mesh material petal being placed in between the hole and the edge of the board, after removal of the clothespin from the mesh material petal.
Figure 44:
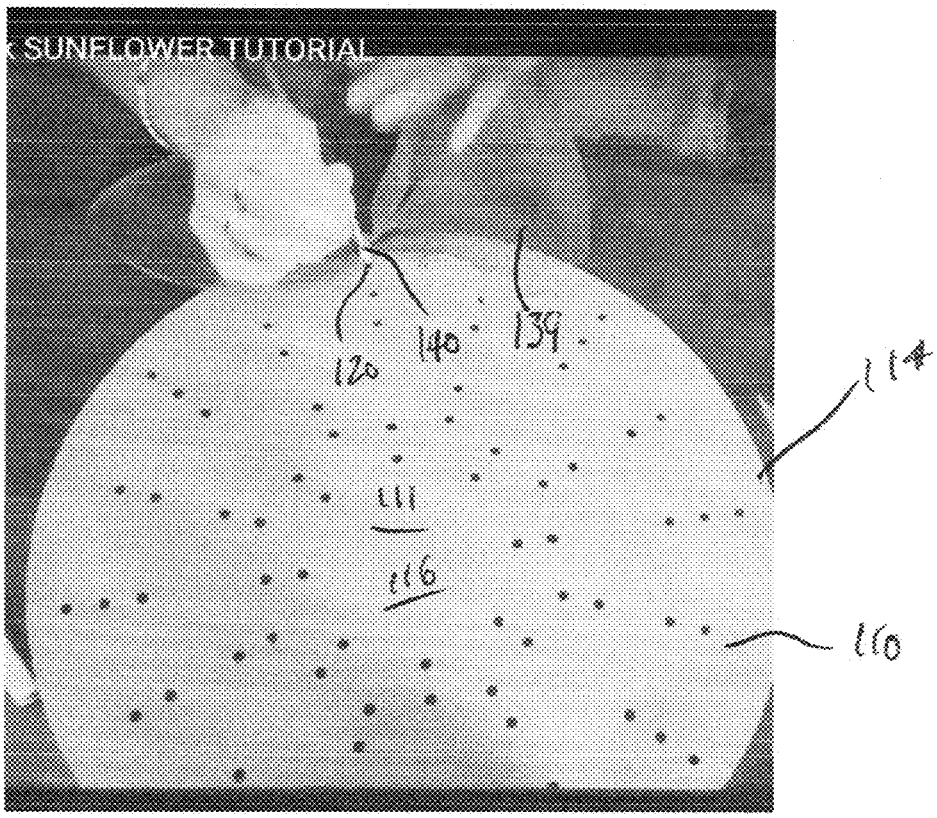
FIG. 44 is a diagrammatic view showing one of the flexible securing members being closed around the mesh material petal.
Figure 45:
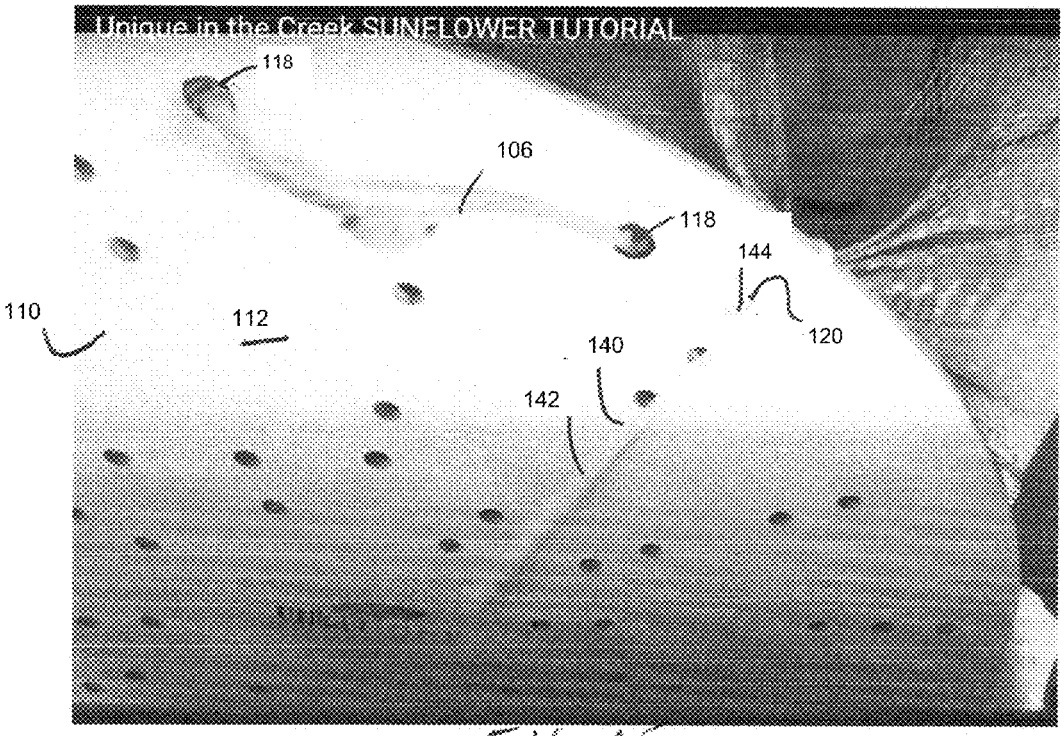
FIG. 45 is a diagrammatic view showing one of the flexible securing members being tightened around the mesh material petal.
Figure 46:
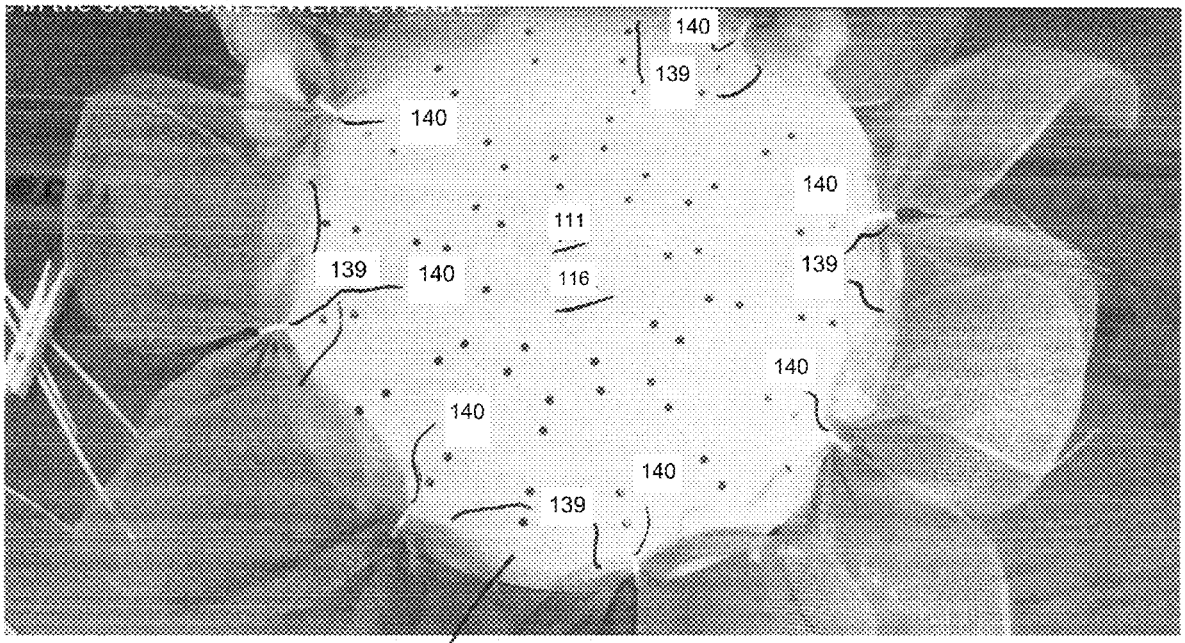
FIG. 46 is a diagrammatic view showing all of the mesh material petals adjacent the perimeter of the frame have been installed.

The next step, as can be seen in FIG. 41, is to place the frame 110 with the first decoration-receiving face 111 facing upwardly. The serrated elongate tail 142 of one of the flexible securing members 140 is then inserted into one of the receiving holes 120 of the frame 110 in the first circular pattern 120*a* of receiving holes 120, as shown in FIG. 42. After removing the clothes pin 150, the pinched vertex 138 of the mesh material petal 139, which is a decoration, is placed on the frame inbetween the receiving hole 120 and the circular peripheral edge 114 of the frame 110, as can be seen in FIG. 43. The flexible securing member 140 is then closed to a decoration-retaining configuration around the surrounded portion of the mesh material petal 139, more specifically around the pinched vertex of the mesh material petal 139, and the surrounded portion of the frame 110, as can be seen in FIG. 44, to thereby secure the mesh material petal 139 in outwardly projecting relation onto the frame. Next, as shown in FIG. 45, the flexible securing member 140 is tightened until the head 144 of the flexible securing member 140 is at least partially engaged within the receiving hole 120 adjacent the second decoration-receiving face 112 of the frame 110, to thereby tightly secure the mesh material petal 139 in outwardly projecting relation onto the frame 110, and thereby helping to preclude the flexible securing member 140 from moving. FIG. 46 shows all of the mesh material petals 139 having been secured to the frame 110 at the first circular pattern 120*a* of receiving holes 120. It should be noted that the flexible securing member 140 is closed and/or tightened to a locked decoration-retaining configuration, which in the first illustrated embodiment is possible as the serration-engaging tooth 148 is situated at the tail-receiving aperture 146 so as to engage the serrations 143 of the serrated elongate tail 142 of the flexible securing member 140.

Figure 47:
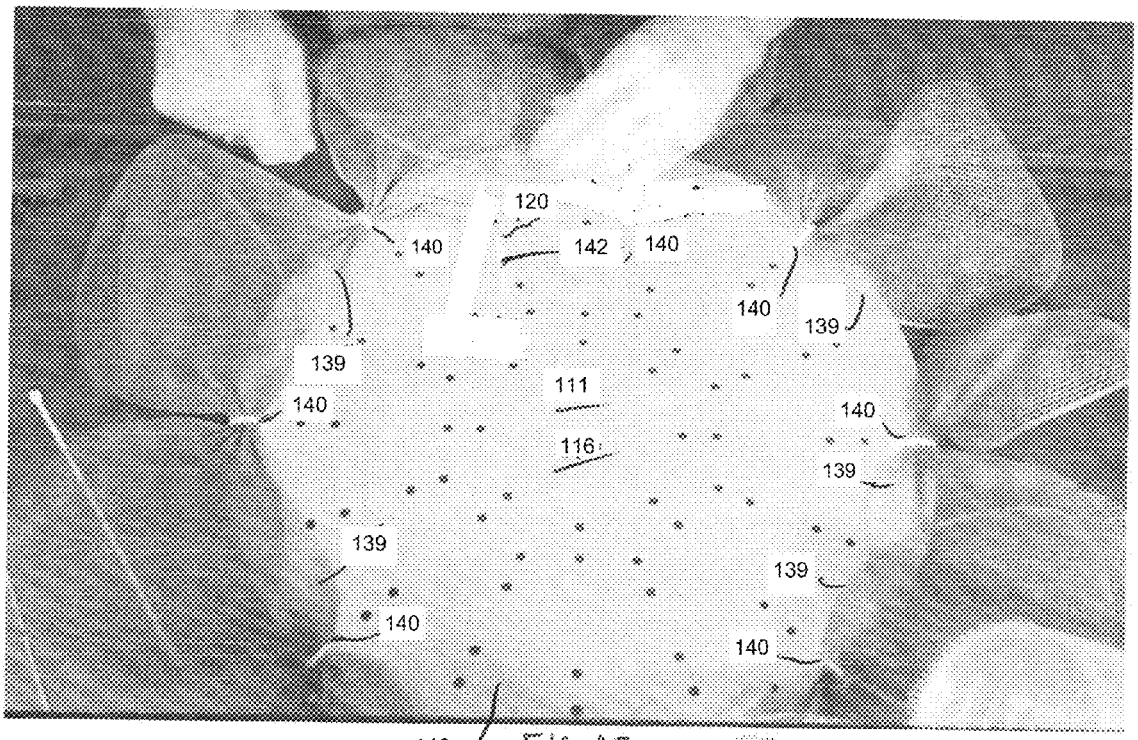
FIG. 47 is a diagrammatic view showing the tail of one of the flexible securing members being inserted into one of the holes of the frame one circular row in from the periphery.
Figure 48:
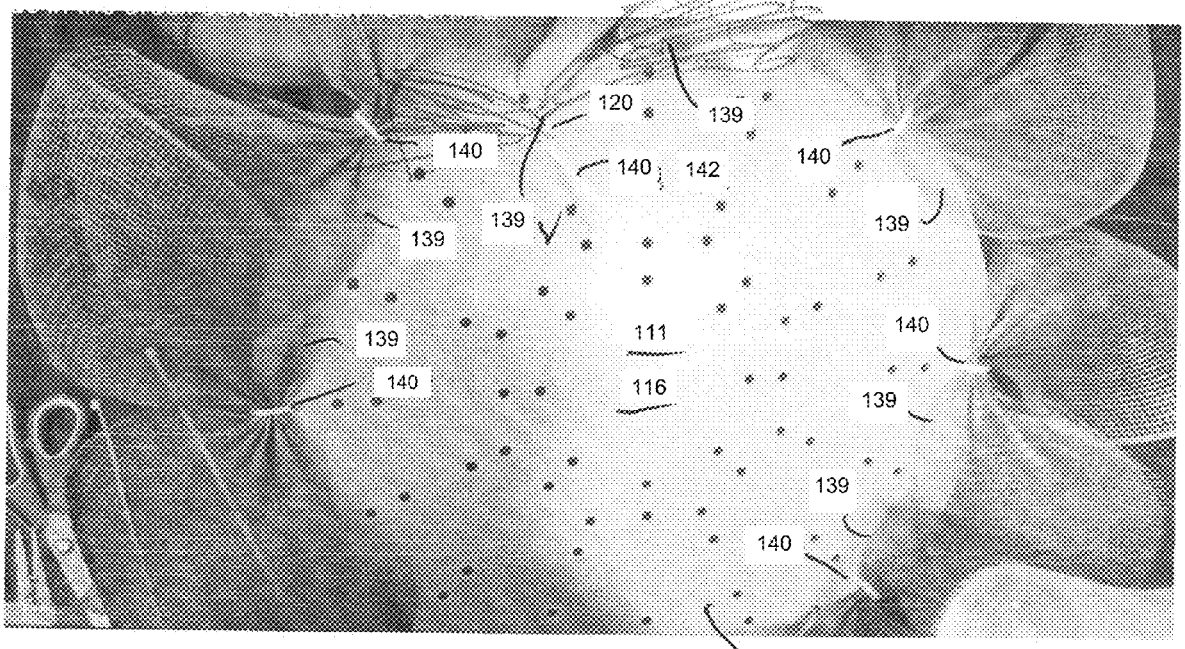
FIG. 48 is a diagrammatic view showing the pinched vertex of the mesh material petal being placed in between the hole and the edge of the board, after removal of the clothespin from the mesh material petal.
Figure 51:
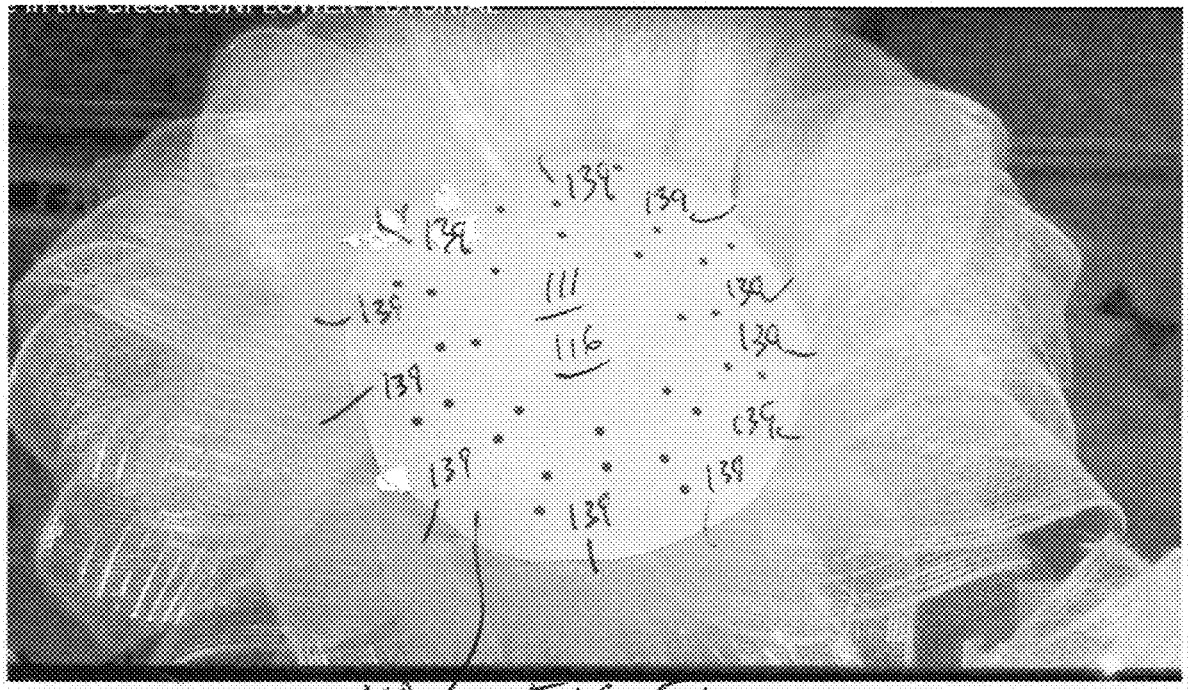
FIG. 51 is a diagrammatic view showing all of the mesh material petals of the second circular pattern of receiving holes having been secured onto the frame.

Next, the same method is repeated for the second circular pattern 120*b* of receiving holes 120. As can be seen in FIG. 47, the serrated elongate tail 142 of the flexible securing member 140 is inserted into one of the innermore holes of the radially aligned pairs of receiving holes 120 in the second circular pattern 120*b* of receiving holes 120. After removing the clothes pin 150, the pinched vertex of the mesh material petal 139 is placed inbetween the two radially aligned receiving holes 120, as shown in FIG. 48. The flexible securing member 140 is then closed around the pinched vertex of the mesh material petal 139, as is shown in FIG. 49. Next, as shown in FIG. 50, the flexible securing member 140 is tightened until the head 144 of the flexible securing member 140 is at least partially engaged within the receiving hole 120 adjacent the second decoration-receiving face 112 of the frame 110, thereby helping to preclude the flexible securing member 140 from moving. FIG. 51 shows all of the mesh material petals 139 in the second circular pattern 120*b* of receiving holes 120 having been secured to the frame 110.

Figure 52:
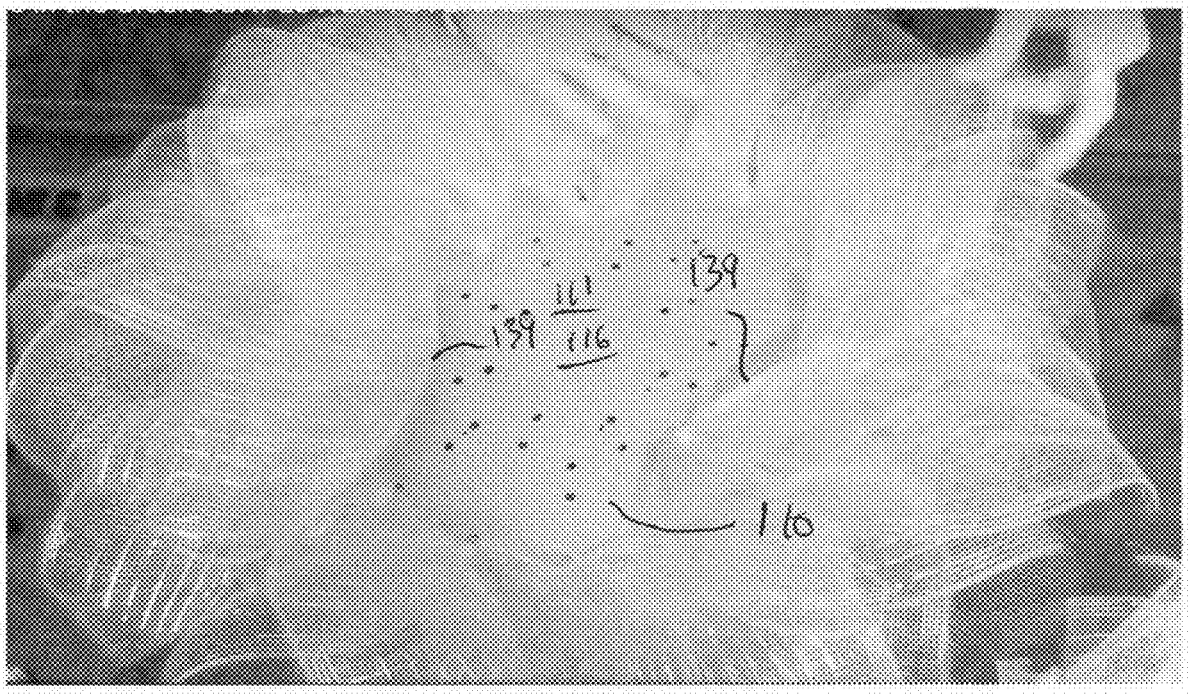
FIG. 52 is a diagrammatic view showing two of the mesh material petals in the third circular pattern of receiving holes having been secured onto the frame.

FIG. 52 shows two of the mesh material petals 139 in the second circular pattern 120*b* of receiving holes 120 of the frame 110 having been secured to the frame 110. As can be seen in FIG. 53, for the third circular pattern 120*c* of receiving holes 120, two mesh material petals 139 may be used at each pair of receiving holes 120, to thereby form a double petal. FIG. 54 shows all of the mesh material petals 139 in the third circular pattern 120*c* of receiving holes 120 having been secured to the frame 110.

Similarly, FIG. 55 shows all of the pieces of mesh material petal 139 in the fourth circular pattern 120*d* of receiving holes 120, which is closest to the central inner core area 116 of the frame 110, having been secured to the frame 110. Accordingly, all of the mesh material petals 139 having been secured in all the circular patterns 120*a*, 120*b*, 120*c*, 120*d* of receiving holes of the frame 110. If desired, the flexible securing members 140 can be cut to a short length once tightened in place.

The final steps of securing the optional foam center disc 170 to the frame 110 will now be discussed.

As can be seen in FIG. 56, an amount of hot melt adhesive 172 is applied to the edge of the mesh material petal 139, in the fourth circular pattern of receiving holes of the frame, adjacent the central inner core area 116, using a hot melt adhesive gun 174. Clothes pins 150 are used to pinch together the adjacent portions of each of the eight mesh material petals 139 one to the next, as shown in FIG. 57. FIG. 58 shows the foam center disc 170 being secured to the central inner core area 116 of the frame 110 using a hot melt adhesive 172. FIG. 59 shows the finished frame-based decorative article 100, which beautifully resembles a sunflower.

Reference will now be made to FIGS. 60 and 61, which show a second illustrated embodiment of the frame-based decorative article according to the present invention, as indicated by the general reference numeral 200. As can be readily seen, the frame-based decorative article 200 comprises a wreath 200*w*. The second illustrated embodiment of the present invention is similar to the first illustrated embodiment of the present invention and comprises a frame 210, a first decoration-receiving face 211, second decoration-receiving face 212, a main body 213 that is illustrated as being substantially planar, a circular peripheral edge 214, and a hanging member 206 extending through the two mounting holes 218. There is a plurality of receiving holes 220 in the main body 213. The receiving holes 220 are arranged in a first circular pattern 220*a*, a second circular pattern 220*b*, a third circular pattern 220*c*, a fourth circular pattern 220*d*, and a fifth circular pattern 220*e*. The first circular pattern 220*a*, the second circular pattern 220*b*, the third circular pattern 220*c*, the fourth circular pattern 220*d*, and the fifth circular pattern 220*e* are generally concentric one with the other, and the fifth circular pattern 220*e* is adjacent the centre point "C" of the frame 210. Accordingly, petals 239 that are secured to the frame 210 at the fifth circular pattern 220*e* would generally cover the central area around the centre point "C", which is desirable for making wreaths and table decorations that resemble certain types of flowers.

In a first radially aligned row pattern "F" of receiving holes 220, there are receiving holes 220 disposed at the first circular pattern 220*a* of receiving holes 220, the second circular pattern 220*b* of receiving holes 220, the fourth circular pattern 220*d* of receiving holes 220, and the fifth circular pattern of receiving holes 220, and in the second radially aligned row pattern "S" of receiving holes 220, there are receiving holes 220 disposed at the second circular pattern 220*b* of receiving holes 220, the third circular pattern 220*c* of receiving holes 220, and the fifth circular pattern of receiving holes 220.

It should be understood that any and/or all of the above method steps, including associated drawings and/or pictures, may be included in a set of instructions that may be provided as a hard copy (paper) or may be provided as an electronic file, presented either on-line or downloadable, or in any other suitable format.

Other variations of the above principles will be apparent to those who are knowledgeable in the field of the invention, and such variations are considered to be within the scope of the present invention. Further, other modifications and alterations may be used in the design and manufacture of the method according of the present invention, without departing from the spirit and scope of the accompanying claims.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising", "having", "including", and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as", "for example") provided herein, is intended merely to better illuminate embodiments of the invention and does not pose a limitation on the scope of the invention unless otherwise claimed. No language in the specification should be construed as indicating any non-claimed element as essential to the practice of the invention.

Illustrated embodiments of this invention are described herein. Variations of those illustrated embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A frame-based decorative article, comprising:

a circular planar frame, the circular planar frame defining a center point;

a first series of pairs of radially aligned receiving holes defined in the frame and arranged in a circular pattern around the center point, the first series of receiving holes defining a first radius between the center point and a midpoint between each pair of holes;

a second series of pairs of radially aligned receiving holes defined in the frame and arranged in a circular pattern around the center point, the second series of receiving holes defining a second radius between the center point and a midpoint between each pair of holes;

wherein the pairs of receiving holes in the second series are arranged between the pairs of rows in the first series in an alternating pattern and wherein the first radius is different from the second radius;

a third series of pairs of radially aligned receiving holes defined in the frame and arranged in a circular pattern around the center point, the third series of receiving holes defining a third radius between the center point and a midpoint between each pair of holes; and wherein the receiving holes in the third series are radially aligned in row patterns with the receiving holes in the first series and wherein the first radius is different from the third radius.

2. The frame-based decorative article of claim 1, comprising:

a fourth series of pairs of radially aligned receiving holes defined in the frame and arranged in a circular pattern around the center point, the fourth series of receiving holes defining a fourth radius between the center point and a point midway between the holes in each pair;

wherein the receiving holes in the fourth series are radially aligned in row patterns with the receiving holes in the second series and wherein the fourth radius is different from the second radius.

3. The frame-based decorative article of claim 2, wherein the fourth radius is equal to the third radius.

4. The frame-based decorative article of claim 2, comprising a fifth series of receiving holes defined in the frame and arranged in a circular pattern concentrically outward of the fourth series of receiving holes and adjacent a circular peripheral edge of the frame.

5. The frame-based decorative article of claim 4, wherein the receiving holes in the fifth series are radially aligned in row patterns with receiving holes in the third series.

6. The frame-based decorative article of claim 1, comprising a plurality of flexible plastic securing members.

7. The frame-based decorative article of claim 6 wherein each securing member extends through a selected pair of receiving holes in the frame and surrounds a portion of at least one decoration to secure the surrounded portion to the frame between the selected pair of receiving holes.

8. The frame-based decorative article of claim 7, wherein the at least one decoration is comprised of a plastic mesh material.

9. A frame-based decorative article, comprising:

a circular planar frame, the circular planar frame defining a center point;

a first series of pairs of radially aligned receiving holes defined in the frame and arranged in a circular pattern around the center point;

a second series of pairs of radially aligned receiving holes defined in the frame and arranged in a circular pattern spaced concentrically outward of the first series of receiving holes;

a third series of pairs of radially aligned receiving holes defined in the frame and arranged in a circular pattern spaced concentrically outward of the second series of receiving holes;

wherein the receiving holes in the third series are radially aligned in row patterns with the receiving holes in the first series; and wherein the receiving holes in the second series are in row patterns offset from the receiving holes in the first series.

10. The frame-based decorative article of claim 9, comprising:

a fourth series of pairs of radially aligned receiving holes defined in the frame and arranged in a circular pattern spaced concentrically outward of the second series of receiving holes.

11. The frame-based decorative article of claim 10, wherein the receiving holes in the fourth series are in row patterns radially aligned with the receiving holes in the second series.

12. The frame-based decorative article of claim 11, comprising:

a plurality of flexible securing members, each securing member extending through a selected pair of receiving holes in the frame and surrounding a portion of at least one decoration, to secure the surrounded portion to the frame between the selected pair of receiving holes.

13. The frame-based decorative article of claim 12, wherein the at least one decoration is comprised of a plastic mesh material.

14. A frame-based decorative article, comprising:

a planar frame;

a first series of pairs of receiving holes defined in the frame and arranged in a circular pattern;

a second series of pairs of receiving holes defined in the frame and arranged in a circular pattern concentrically outward of the first series of receiving holes;

a third series of pairs of receiving holes defined in the frame and arranged in a circular pattern concentrically outward of the second series of receiving holes;

wherein the receiving holes in the third series are radially aligned in row patterns with the receiving holes in the first series; and wherein the receiving holes in the second series are in row patterns offset from the receiving holes in the first series.

15. The frame-based decorative article of claim 14, comprising:

a fourth series of pairs of receiving holes defined in the frame and arranged in a circular pattern concentrically outward of the second series of receiving holes.

16. The frame-based decorative article of claim 15, wherein the receiving holes in the fourth series are radially aligned in row patterns with the receiving holes in the second series.

17. The frame-based decorative article of claim 15, comprising:

a fifth series of receiving holes defined in the frame and arranged in a circular pattern concentrically outward of the fourth series of receiving holes and adjacent a circular peripheral edge of the frame.

18. The frame-based decorative article of claim 17, wherein the receiving holes in the fifth series are radially aligned in row patterns with the receiving holes in the third series.

19. The frame-based decorative article of claim 14, comprising:

a plurality of flexible securing members, each securing member extending through a selected pair of receiving holes in the frame and surrounding a portion of at least one decoration, to secure the surrounded portion to the frame between the selected pair of receiving holes.

20. The frame-based decorative article of claim 19, wherein the at least one decoration is comprised of a plastic mesh material.

21. A frame-based decorative article, comprising:

a circular planar frame;

a first pattern including a plurality of sets of pairs of radially aligned receiving holes defined in the frame and arranged in a circular pattern;

a second pattern including a plurality of sets of pairs of radially aligned receiving holes defined in the frame and arranged in a circular pattern concentrically outward of the first series of receiving holes;

a third pattern including a plurality of sets of pairs of radially aligned receiving holes defined in the frame and arranged in a circular pattern concentrically outward of the second series of receiving holes; and a fourth pattern including a plurality of sets of three radially aligned receiving holes arranged in a circular pattern concentrically outward of the second series of receiving holes.

22. The frame based decorative article of claim 21, wherein the receiving holes in the fourth pattern are concentrically aligned with the receiving holes in the third pattern.

23. The frame-based decorative article of claim 21, wherein the receiving holes in the second pattern are radially aligned in rows offset from the receiving holes in the first pattern.

24. The frame-based decorative article of claim 21, wherein the receiving holes in the third pattern are radially aligned in rows with the receiving holes in the second pattern.

25. The frame-based decorative article of claim 21, wherein the receiving holes in the fourth pattern are radially aligned in rows with the receiving holes in the first pattern.

* * * * *